US008636349B2

(12) United States Patent
Nakakubo et al.

(10) Patent No.: US 8,636,349 B2
(45) Date of Patent: Jan. 28, 2014

(54) LIQUID EJECTION HEAD AND LIQUID EJECTION APPARATUS

(75) Inventors: Toru Nakakubo, Kawasaki (JP); Yohei Nakamura, Kawasaki (JP); Hiroshi Netsu, Yokohama (JP); Hiromitsu Morita, Sakado (JP); Junya Kawase, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/805,420

(22) PCT Filed: Jul. 4, 2011

(86) PCT No.: PCT/JP2011/003804

§ 371 (c)(1),
(2), (4) Date: Dec. 19, 2012

(87) PCT Pub. No.: WO2012/014379

PCT Pub. Date: Feb. 2, 2012

(65) Prior Publication Data

US 2013/0093819 A1 Apr. 18, 2013

(30) Foreign Application Priority Data

Jul. 28, 2010 (JP) ..... 2010-169383
Nov. 1, 2010 (JP) ..... 2010-245541
Dec. 15, 2010 (JP) ..... 2010-279364

(51) Int. Cl.
*B41J 2/185* (2006.01)

(52) U.S. Cl.
USPC ..... 347/90

(58) Field of Classification Search
USPC ..... 347/73–82, 90
See application file for complete search history.

(56) References Cited

U.S. PATENT DOCUMENTS 4,667,207 A 5/1987 Sutera et al.
6,851,796 B2 * 2/2005 Jeanmaire et al. ..... 347/74
7,144,102 B2 * 12/2006 Hengesbach et al. ..... 347/73
7,699,455 B2 * 4/2010 Matsuda et al. ..... 347/90
7,938,522 B2 * 5/2011 Xie et al. ..... 347/90

FOREIGN PATENT DOCUMENTS

EP 1 332 877 A1 8/2003
EP 1 431 039 A1 6/2004
JP 2003-334957 A 11/2003
JP 2008-143188 A 6/2008
WO 2009/120278 A1 10/2009

OTHER PUBLICATIONS

International Preliminary Report on Patentability mailed Feb. 7, 2013, in International Application No. PCT/JP2011/003804.

* cited by examiner

*Primary Examiner* — Kristal Feggins
(74) *Attorney, Agent, or Firm* — Fitzpatrick, Cella, Harper & Scinto

(57) ABSTRACT

A continuous liquid ejection head collects droplets which are not used for printing (unused droplets) without affecting the flight of droplets which are used for printing (used droplets). An ejection nozzle and a collection nozzle collect an unused droplet by causing a liquid surface to project out from the aperture of the collection nozzle so as to be positioned in the trajectory along which droplets ejected from the ejection nozzle fly, causing the unused droplet to collide and unite with the liquid surface projected from the collection nozzle, and causing the liquid surface to retreat.

21 Claims, 32 Drawing Sheets

LIQUID EJECTION HEAD AND LIQUID EJECTION APPARATUS

TECHNICAL FIELD

The present invention relates to a liquid ejection head and a liquid ejection apparatus provided with the liquid ejection head.

BACKGROUND ART

In what are called continuous droplet ejection apparatus, continuous pressure is applied to liquid with a pump to push the liquid out from a nozzle, and vibration is additionally applied by vibrating manner, thereby forming a state wherein liquid is evenly ejected from a nozzle as droplets. Since droplets are continuously ejected from a nozzle with this method, it is necessary to sort droplets that are used for printing from the droplets that are not used in accordance with print data. With what is called a charge deflection method, such sorting is conducted by selectively charging droplets, deflecting the droplets with an electric field, and causing the charged droplets to fly in a trajectory different from that of the non-charged droplets. Sorted non-print droplets are captured by a gutter and collected. In order to realize these functions, a charging electrode, a deflecting electrode, and a gutter are provided along the droplet flight trajectory from a nozzle.

Patent Literature 1 discloses a method of sorting that differs from a charge deflection method and does not charge droplets. More specifically, Patent Literature 1 discloses a configuration wherein large droplets and small droplets are separately ejected by a nozzle and made to pass through a liquid curtain consisting of misted droplets that were formed along the droplet flight path. In so doing, the small droplets are captured, and only the large droplets are made to land onto a print medium. Also, Patent Literature 2, although not a continuous liquid ejection apparatus, discloses technology that causes a separate droplet to collide with a flying droplet. More specifically, Patent Literature 2 discloses a configuration wherein a droplet from a first ejection port (main droplet) is made to collide with a droplet from a second ejection port, thereby altering its flight direction. In so doing, only a satellite droplet (microdroplet) from the first ejection port is made to land onto a print medium, thereby making it possible to miniaturize print dots.

CITATION LIST

Patent Literature

PTL 1: Japanese Patent Laid-Open No. 2003-334957
PTL 2: Japanese Patent Laid-Open No. 2008-143188

SUMMARY OF INVENTION

Meanwhile, if a print droplet is charged, it will be susceptible to electrostatic interaction with preceding and successive charged droplets and charged mist adhering to the wall surface. This is a problem because the droplet's flight trajectory will alter and landing precision will worsen. Even in cases where a print droplet is not made to be charged, the print droplet may sometimes become charged due to electrostatic induction from the influence of preceding charged droplets.

Also, with the method illustrated in Patent Literature 1, since print droplets also pass through the liquid curtain, there is a risk that print droplets will be susceptible to the effects of the liquid curtain and have their landing positions altered.

Also, with the method illustrated in Patent Literature 2, separate droplets are made to fly and land in a gutter in order to capture non-print droplets, but there is a risk that splash mist will occur during landing and contaminate the flight path.

One object of the present invention is to provide a liquid ejection head able to raise the landing precision of used droplets (print droplets) while also suppressing the creation of mist along the droplet flight path, and in addition, to provide a liquid ejection apparatus provided with the liquid ejection head.

A liquid ejection head of the present invention includes a first nozzle that continuously ejects droplets and collecting mechanism configured to collect unused droplets which are not used from among the droplets continuously ejected from the first nozzle. The collecting mechanism includes a second nozzle able to project a liquid surface positioned along the trajectory in which droplets ejected from the first nozzle fly, and a liquid surface driving mechanism that collects unused droplets ejected from the first nozzle by causing a liquid surface to be projected from the second nozzle, causing the unused droplets to collide and unite with the projected liquid surface, and causing the projected liquid surface to retreat.

According to the present invention, it is possible to raise the landing precision of used droplets (print droplets), since it is possible to sort and collect unused droplets (non-print droplets) without influencing the used droplets (print droplets). Also, since the liquid surface projected from the second nozzle for sorting does not form flying droplets, the creation of mist along the droplet flight path can be suppressed, and head reliability can be improved.

Further features of the present invention will become apparent from the following description of exemplary embodiments (with reference to the attached drawings).

DESCRIPTION OF EMBODIMENTS

Hereinafter, embodiments of the present invention will be described with reference to the drawings. The ejectant of a liquid ejection head of the present invention is not limited to print ink using color material, but is instead applicable to liquids in general. Also, although a liquid ejection head of the present invention is described by way of an example of the case of causing droplets to land on a print medium for use in printing, its application is not limited to printing, and is also widely applicable to manufacturing apparatus using liquids consisting of conductive materials and polymers, and analysis apparatus using liquids that include proteins, for example.

First Embodiment

Figure 1:
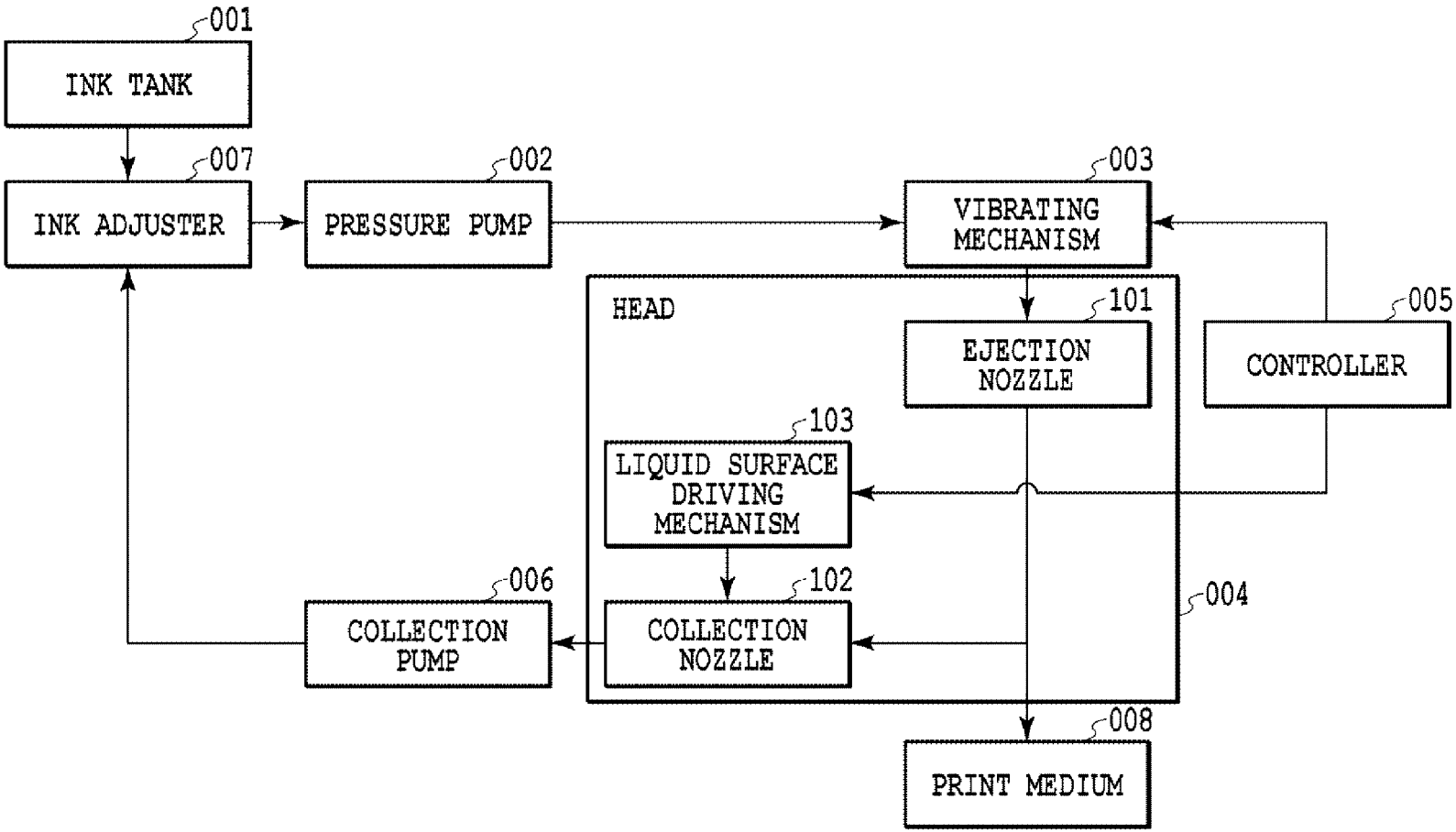
FIG. 1 is a schematic system diagram of a liquid ejection apparatus in accordance with a first embodiment of the present invention.
Figure 2:
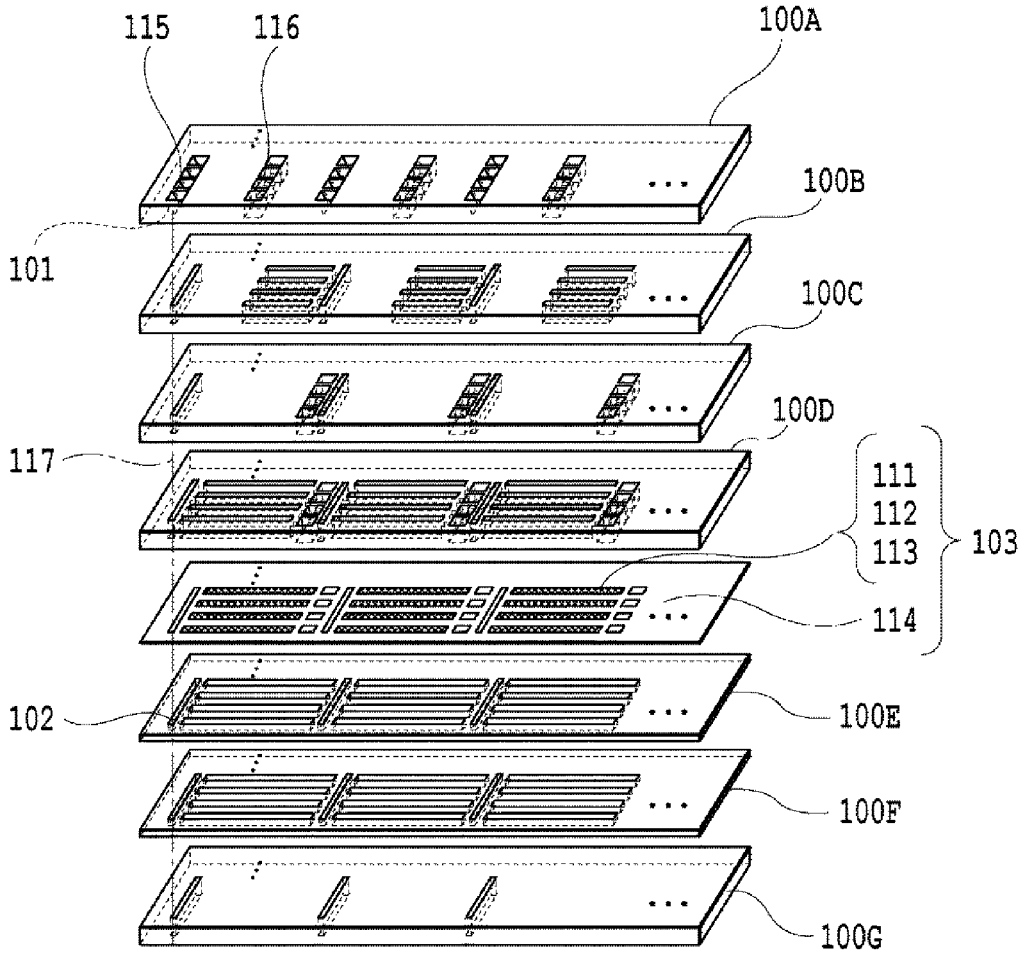
FIG. 2 is an exploded perspective view of a liquid ejection head of the first embodiment.
Figure 3:
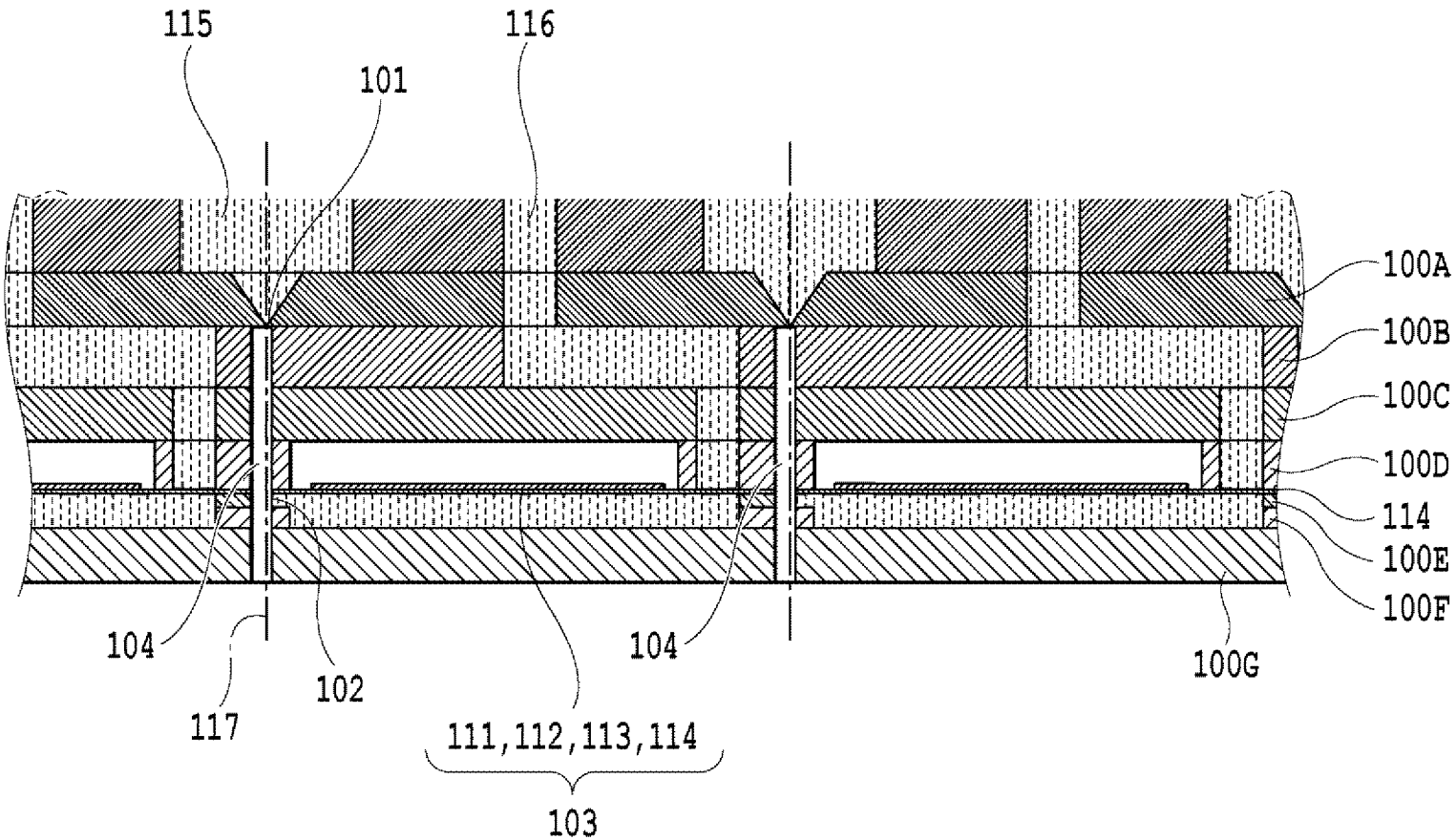
FIG. 3 is a cross-section of a liquid ejection head of the first embodiment.

FIG. 1 is a schematic system diagram of a liquid ejection apparatus equipped with a liquid ejection head in accordance with a first embodiment of the present invention. A liquid ejection apparatus of the present invention is made up of an ink tank 001, a pressure pump 002, a vibrating mechanism 003, a head 004, a controller 005, a collection pump 006, and an ink adjuster 007. FIGS. 2 and 3 are an exploded perspective view and a cross-section of the head 004. As illustrated in FIG. 1, the head 004 includes ejection nozzles 101 (first nozzles), collection nozzles 102 (second nozzles), and liquid surface driving mechanisms 103.

As illustrated in FIGS. 2 and 3, the head 004 has a layered configuration of planar members 100A to 100D, a vibrating plate 114, and planar members 100E to 100G, in that order. On these are formed the ejection nozzles 101, the collection nozzles 102, and the liquid surface driving mechanisms 103. Silicon, stainless steel, resinous materials, etc. may be used for the planar members. By manufacturing these planar members by photolithographic patterning, etching, or pressing, the planar members can be processed all at once and the number of parts is not increased, even in the case of increasing the number of nozzles, and a head can be manufactured at low cost.

Formed on the planar member 100A are a plurality of ejection nozzles 101, supply channels 115 that supply ejection ink to these ejection nozzles, and collection channels 116. Herein, the plurality of ejection nozzles 101 are arrayed in a given direction, and constitute a plurality of nozzle lines. Respectively formed on the planar members 100B and 100D are apertures for forming flight paths 104 through which ink droplets ejected from each ejection nozzle 101 pass through, and apertures that form the collection channel 116. Herein, the apertures that form the flight paths 104 are formed in individual slits for each nozzle line. Formed on the vibrating plate 114 are upper electrodes 111, piezoelectric elements 112 on a thin film, and lower electrodes 113. The upper electrodes 111, the piezoelectric elements 112, the lower electrodes 113, and the vibrating plate 114 form the liquid surface driving mechanisms 103. Sputtering, etc. may be used for deposition of the upper electrodes 111, piezoelectric elements 112, and lower electrodes 113, or dry etching may be used for their patterning. Respectively formed on the planar members 100E and 100F are apertures for forming the collection nozzles 102 and the flight paths 104. Formed on the planar member 100G are apertures that form the flight paths 104. In addition, part of the collection nozzles 102 are demarcated on the top surface of the planar member 100G. As illustrated in FIG. 3, a collection nozzle 102 is able to project a liquid surface driven by a liquid surface driving mechanism 103 out from the aperture of the collection nozzle 102, with the projected liquid surface being positioned at a position along a trajectory 117 of droplets continuously ejected from an ejection nozzle 101.

Figure 4A:
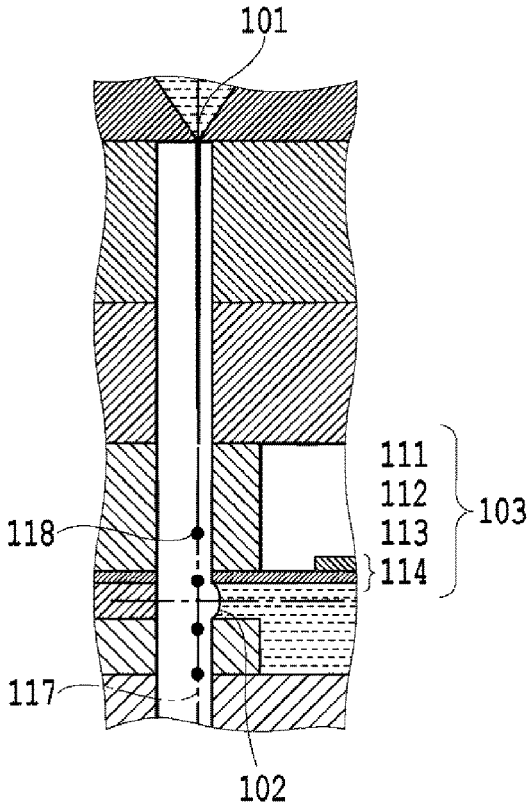
FIG. 4A is a cross-section explaining operation of a liquid ejection apparatus of the first embodiment, illustrating a state wherein the liquid surface inside a collection nozzle has retreated.

Next, operation of a liquid ejection apparatus of the present embodiment will be explained with reference to the head cross-sections illustrated in FIGS. 4A and 4B. Ink stored in an ink tank 001 is pressurized by a pressure pump 002 and supplied to a head 004. Vibration is applied to the ink supplied to the head 004 by a vibrating mechanism 003, and the ink is ejected from an ejection nozzle 101. Once the ink ejected from the ejection nozzle 101 flies approximately 500 μm to 800 μm, a droplet separates from the liquid column and flies along a droplet flight trajectory 117. Meanwhile, at a collection nozzle 102, negative pressure by a collection pump 006 and meniscus force are balanced, thereby causing a liquid surface to be held near the collection nozzle 102, as illustrated in FIG. 4A.

Figure 4B:
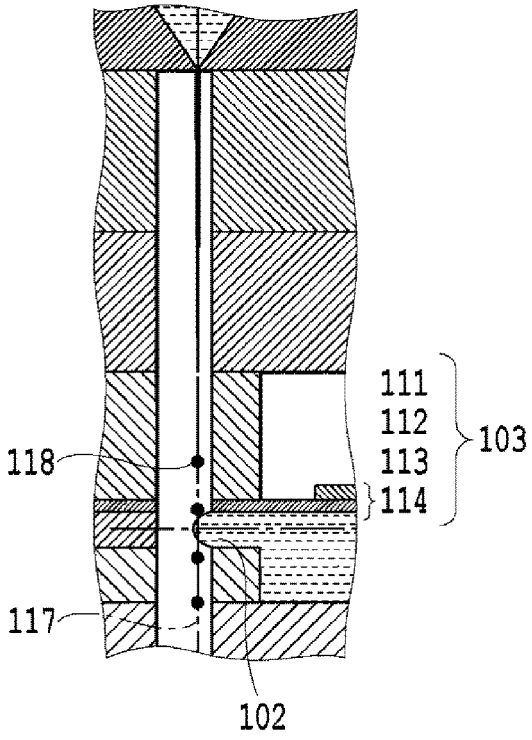
FIG. 4B is a cross-section explaining operation of a liquid ejection apparatus of the first embodiment, illustrating a state wherein the liquid surface inside a collection nozzle has been projected.

When a droplet not used for printing (unused droplet) passes through the vicinity of the collection nozzle 102, as illustrated in FIG. 4B, a signal from a controller 005 causes a liquid surface driving mechanism 103 to project a liquid surface out from the aperture of the collection nozzle 102 at a position along the droplet flight trajectory 117 and collide with the flying unused droplet.

After that, the projected liquid surface unites with the collided droplet, and both return to the original position by the surface tension of the liquid surface. By keeping the pressure constant with the collection pump 006, the liquid surface of the collection nozzle 102 is still kept at a constant position after capture. Particularly, the magnitude of displacement by a liquid surface driving mechanism 103 is controlled so that the projected liquid surface does not form droplets. Captured droplets are gradually sent to the ink adjuster 007, subjected to foreign matter removal and viscosity adjustment, then once again pressurized by the pressure pump 002 and recirculated into the head 004 for reuse. Meanwhile, when a droplet used for printing (used droplet) passes through, the liquid surface of the collection nozzle 102 is not made to project out (advance) and intersect the droplet flight trajectory 117. In so doing, the used droplet proceeds directly to land on a print medium 008.

For example, in FIG. 2, the nozzle spacing in the depth direction is 500 μm and the nozzle spacing in the horizontal direction is 3 mm. Liquid having a viscosity of 1 cP to 40 cP and a surface tension of 30 mN/m is used. If the diameter of an ejection nozzle 101 is taken to be 7.4 μm, the pressure of the pressure pump 002 to be 0.8 MPa, and the vibrational frequency of the vibrating mechanism 003 to be 50 kHz, then the droplet size is 4 pL (diameter approximately 20 μm) and the eject ion velocity is approximately 10 m/s. In an ejection nozzle 101, first a liquid column is formed, and a droplet forms at a location distanced from the ejection nozzle 101 by approximately 500 μm to 800 μm. A collection nozzle 102 has a diameter of 80 μm, and is provided at a point 1 mm away from an ejection nozzle 101 in the droplet flight direction. An ejected droplet decelerates to approximately 8 m/s due to air resistance when passing through the vicinity of a collection nozzle 102. Also, the droplet flight trajectory 117 is distanced 30 μm away from a collection nozzle 102. Ink inside a collection nozzle 102 is controlled with constant negative pressure by a collection pump 006 (approximately −1.4 kPa based on atmospheric pressure), and an ink meniscus formed on the collection nozzle 102. When an unused droplet passes through, the liquid surface of a collection nozzle 102 is advanced by a liquid surface driving mechanism 103 and made to collide with the droplet.

As discussed above, by controlling a liquid surface driving mechanism 103 according to print data, droplets not used for printing can be collected by a projected liquid surface, and only droplets used for printing can be made to land on a print medium 008. A printed print medium 008 is conveyed by a conveying unit (not illustrated).

In the case of conducting high-speed printing, the next droplet may pass through before the liquid surface of a collection nozzle 102 has fully returned to its stasis position. However, even in such cases, if unused droplet capture and used droplet passage are conducted with a sufficient differential in position between when the liquid surface of a collection nozzle 102 is advanced and when it is retreated, a liquid ejection apparatus of the present invention will function.

The present embodiment is discussed for the case where negative pressure is maintained by a collection pump 006 and a liquid surface at a collection nozzle 102 is made to retreat, and when an unused droplet passes through, the liquid surface is made to advance by a liquid surface driving mechanism 103. In contrast, it may also be configured such that positive pressure is maintained by a collection pump 006 and a liquid surface at a collection nozzle 102 is made to advance, and when a used droplet passes through, the liquid surface is made to retreat by a liquid surface driving mechanism 103. In this case, the outer surface of a collection nozzle 102 is preferably processed to be water-repellent and configured such that the liquid surface does not spill and spread out over the outer surface while in a state of applied positive pressure. This method is effective at reducing power consumption and heat while in a state where printing is not being conducted and all ejected ink is being collected, such as during standby.

Figure 5:
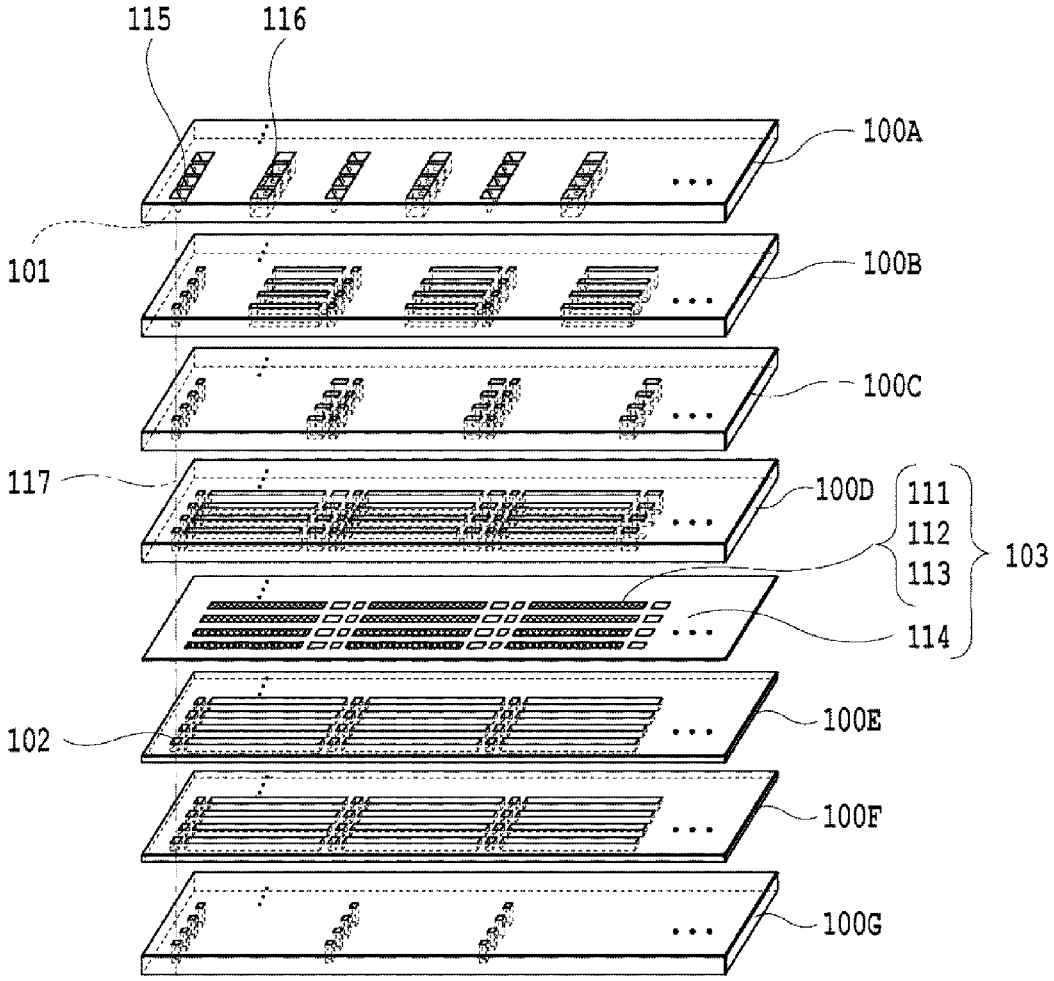
FIG. 5 is an exploded perspective view illustrating another exemplary configuration of a liquid ejection head of the first embodiment.

In FIG. 2, droplet flight paths are slit-shaped and shared on a per-nozzle line basis, but this is not limiting. For example, it may also be configured such that partitions are provided for each ejection nozzle 101 to make the droplet flight paths independent, as illustrated in FIG. 5. Slit-shaped flight paths 104 like those in FIG. 2 have an advantage of being easier to clean when mist, etc. adheres thereto. In contrast, individual flight paths like those in FIG. 5 have an advantage of being resistant to the effects of the air wakes of droplets from adjacent ejection nozzles 101, and thus the landing precision can be raised.

In FIG. 2, a liquid surface driving mechanism 103 uses piezoelectric elements on a thin film, but the driving means of other methods may also be used. For example, in the case of piezoelectric elements, bulk piezoelectric elements may be stacked and used, or piezoelectric elements may be used laterally and deformation in the d15 direction may be used (shear mode). Alternatively, a heater may be used as the driving means and the liquid surface may be driven by bubble formation due to film boiling. In the case of using a heater, a large displacement is easily obtained and the configuration can be made more compact compared to the case of using piezoelectric materials, thus making higher nozzle densities possible. On the other hand, in the case of using piezoelectric elements, liquid surface control can be precisely conducted by optimizing the driving waveform.

Figure 6:
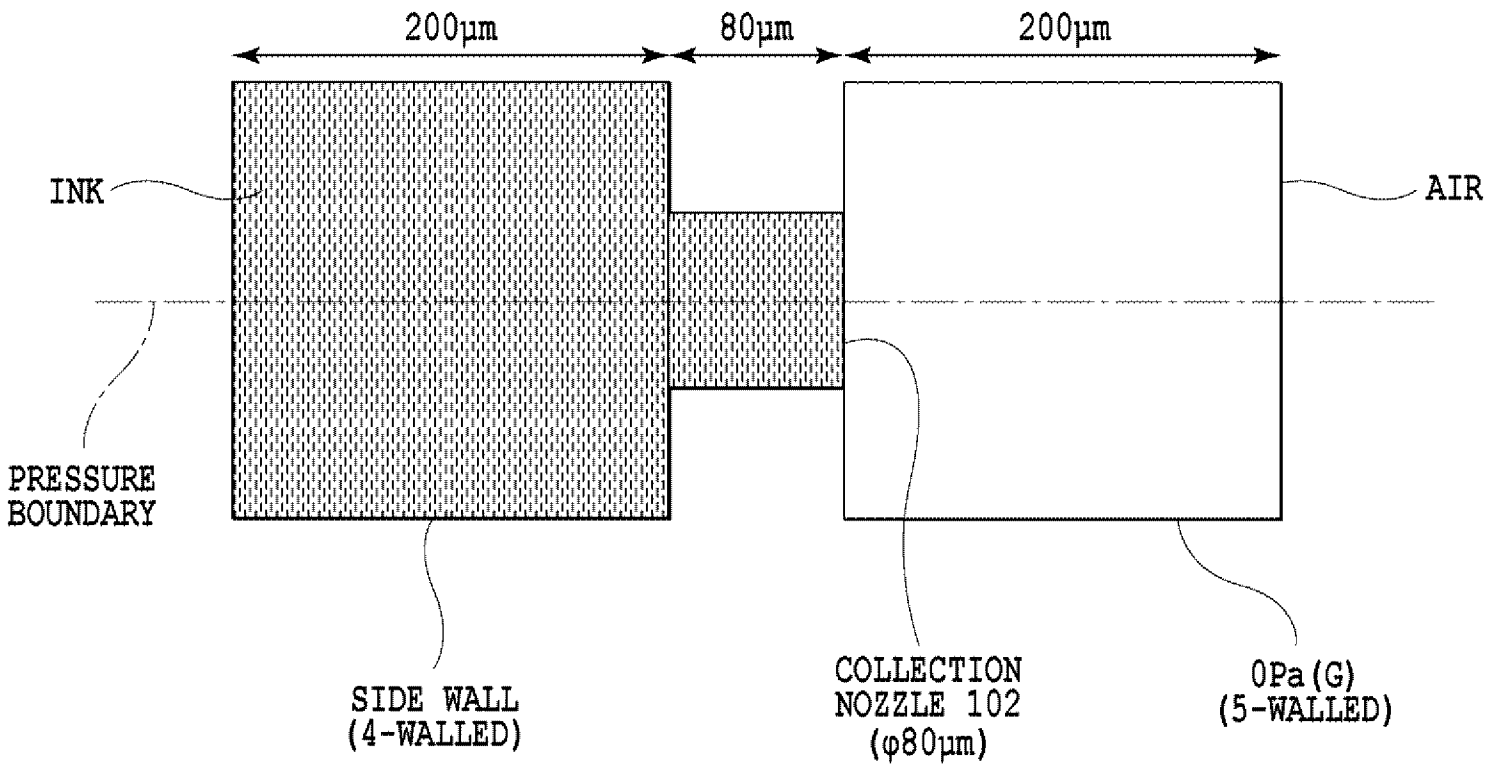
FIG. 6 illustrates a simulation model for operation of a liquid ejection head of the first embodiment.
Figure 7:
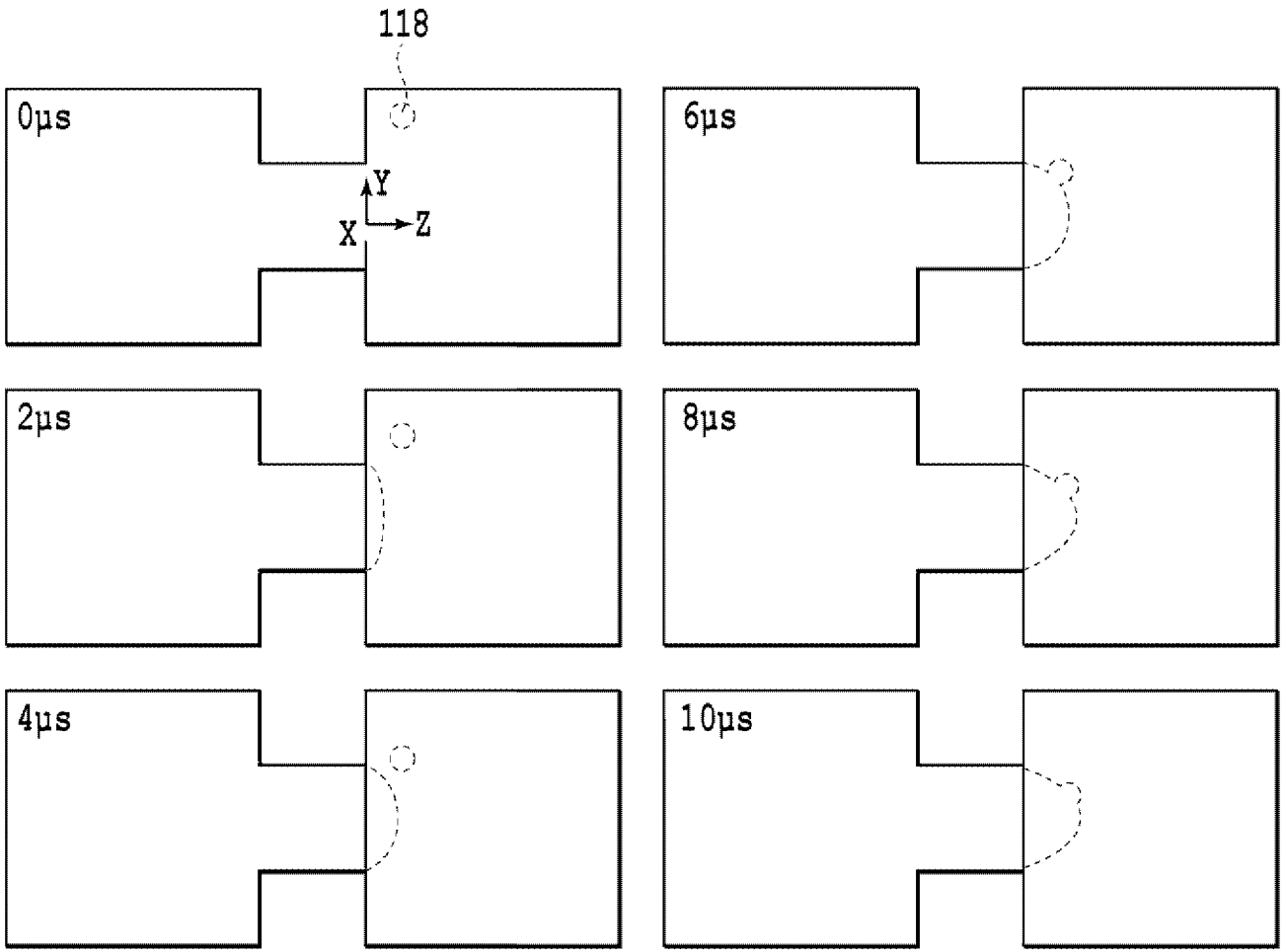
FIG. 7 is a diagram representing simulation results for operation of a liquid ejection head of the first embodiment.

The conditions under which a liquid surface projected from a collection nozzle 102 collides with a flying droplet were analyzed by the general-purpose fluid analysis software Fluent (ANSYS, Inc.). The model used for analysis is illustrated in FIG. 6. In the center of the drawing is a collection nozzle 102 of diameter 80 μm and thickness 80 μm, the left side of which is filled with ink (40 cP), and the right side of which is air. Pressure boundary conditions equivalent to the case of displacing the vibrating plate 114 in FIG. 2 approximately 40 nm were applied to the wall on the left side, causing the liquid surface to advance. Additionally, a 4 pL droplet was made to fly at 8 m/s from vertically above the axis of the collection nozzle 102 at a position distanced 30 μm from the collection nozzle 102, and was made to collide with the liquid surface advanced from the collection nozzle 102. The state of the liquid surface and the droplet at individual times is illustrated in FIG. 7. The advanced liquid surface and the droplet 118 collide at 6 μs. After that, the droplet unites with the liquid surface without spattering and is absorbed into the liquid surface. Also, the liquid surface advanced from the collection nozzle 102 does not form a droplet.

At this point, the liquid surface of the collection nozzle 102 subsequently returns to its original position due to the surface tension of the nozzle unit. If the liquid chamber interior is made to expand by controlling a liquid surface driving mechanism 103, it is possible to revert the liquid surface to its original position more quickly. The volume of ink in the collection nozzle 102 increases as a result of absorbing the droplet 118, but by keeping the pressure of the collection pump 006 constant, the position of the ink meniscus at the collection nozzle 102 is held at the same position. Extra ink is sent to the ink adjuster 007 via the collection pump 006, and after adjusting the ink's viscosity and concentration, the ink is recirculated into the ejection nozzle 101.

The aperture of the collection nozzle 102 is preferably at least double the diameter of droplets ejected from the ejection nozzle 101. If smaller, and there is a risk that an advanced liquid surface will break up when colliding with a droplet. Meanwhile, it is preferable for the advancement magnitude of the liquid surface from the collection nozzle 102 to be approximately equal to the aperture of the collection nozzle 102. If the advancement magnitude is larger, there is a risk that droplet formation will occur or that the liquid surface will become unable to retreat, etc.

If the aperture of the collection nozzle 102 is too large, maintaining a meniscus at the nozzle unit becomes difficult. Also, as the aperture of the collection nozzle 102 becomes larger, it takes more time for an advanced liquid surface to return to its original position, making high-speed driving problematic. For example, in the case of using a liquid with a viscosity of 40 cP and a surface tension of 30 mN/m, a liquid surface can be stably maintained for collection nozzle 102 apertures up to ϕ160 μm, even if the pressure settings of the collection pump 006 are changed.

(Modification 1)

Figure 8:
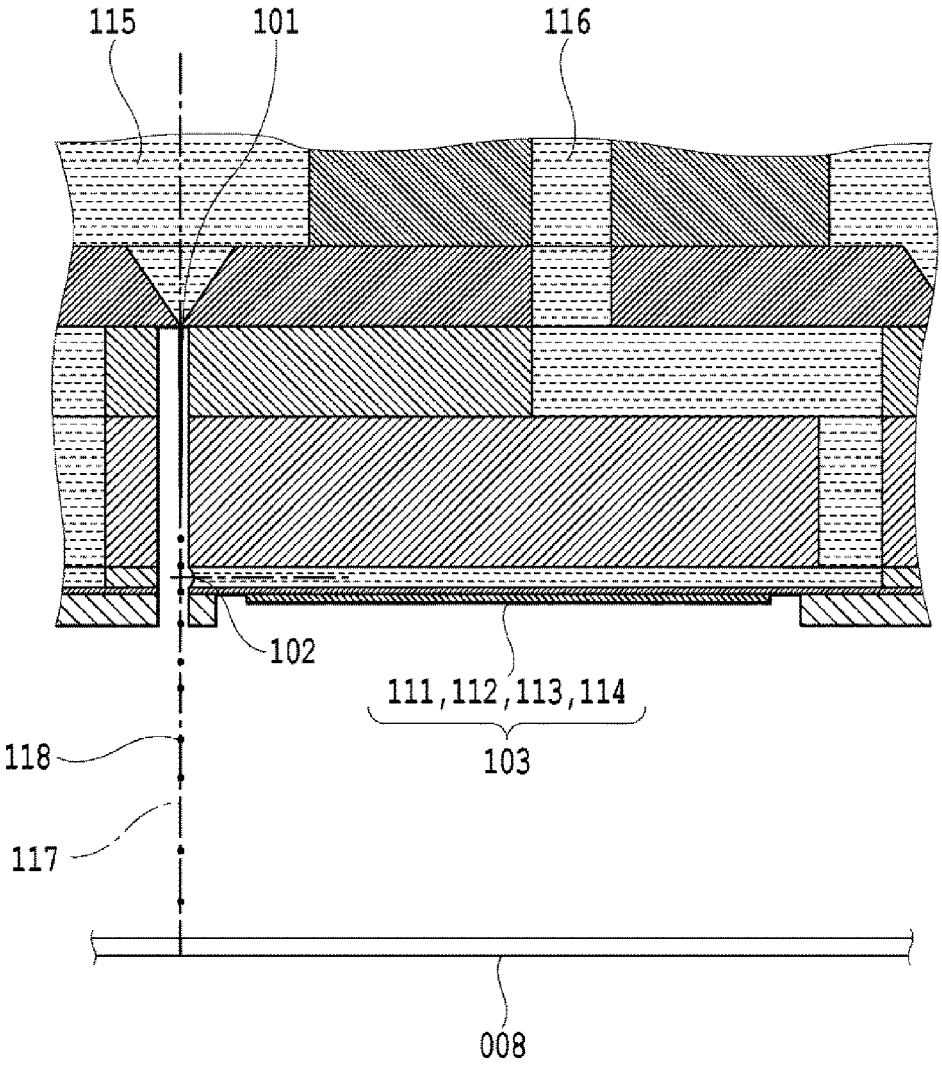
FIG. 8 is a cross-section of a liquid ejection head in accordance with a modification 1 of the first embodiment.

A modification of the first embodiment of the present invention will now be explained. A cross-section of a liquid ejection head of the present modification is illustrated in FIG. 8. Whereas the liquid surface driving mechanism 103 illustrated in FIG. 2 was positioned between a collection nozzle 102 and an ejection nozzle 101, in the present modification, the liquid surface driving mechanism 103 is positioned on the bottom surface of the head, or in other words, facing a print medium 008. In the configuration in FIG. 2, piezoelectric elements 112 or electrodes do not face outwards, thereby yielding a highly durable structure wherein these components are protected from mist or rubbing against a print medium. Also, housing the liquid surface driving mechanism 103 in the space leading up to where droplets 118 are formed has an advantage of enabling a shorter distance between an ejection nozzle 101 and a print medium 008. In contrast, since the upper electrodes 111 and lower electrodes 113 are exposed at the outer surface of the head with the configuration illustrated in FIG. 8, there is an advantage in that wiring is simple and manufacturing is easy compared to the configuration in FIG. 2. Meanwhile, droplet ejection and sorting functions are completely similar to the structure in FIG. 2.

(Modification 2)

Figure 9:
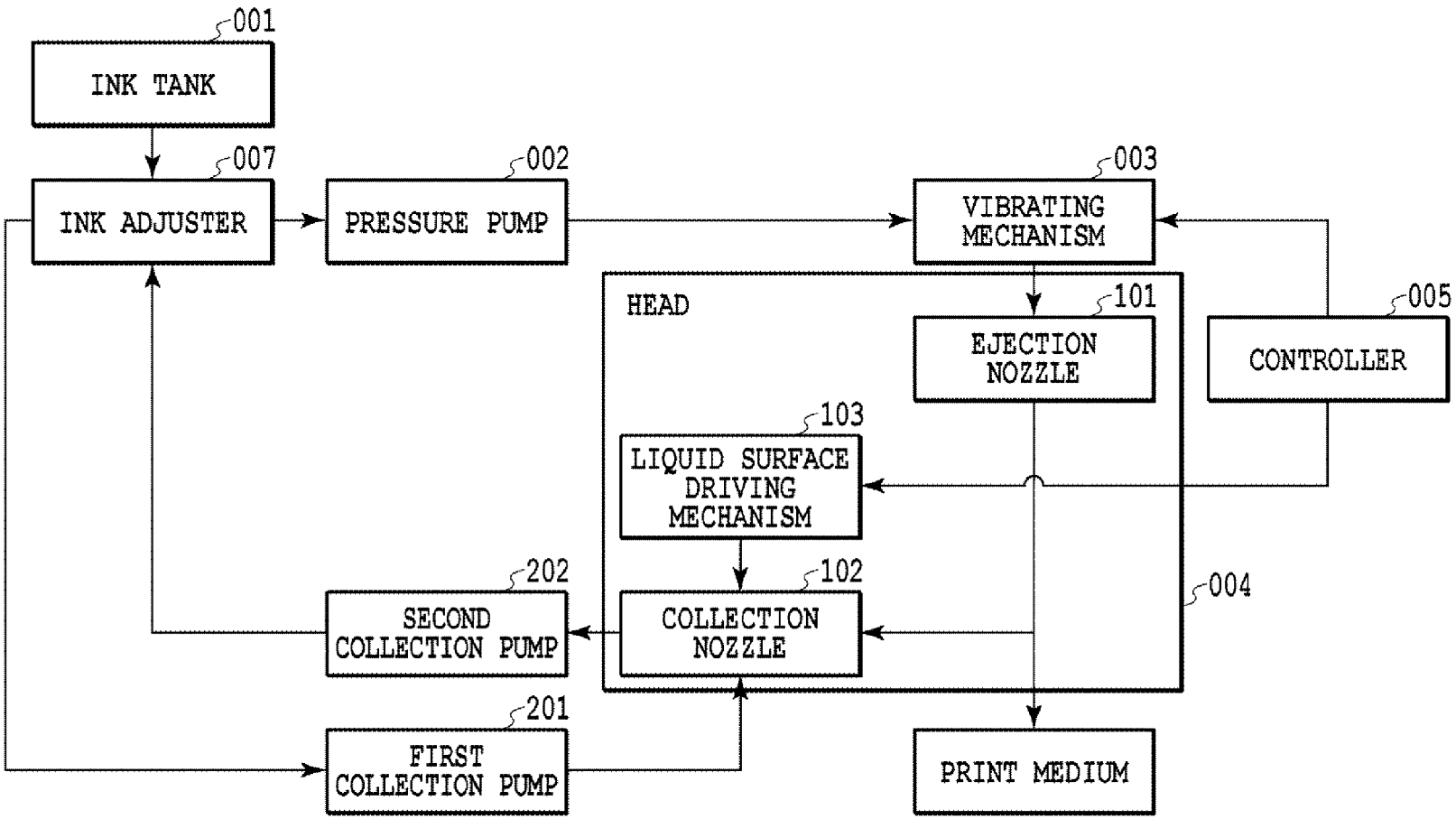
FIG. 9 is a schematic system diagram of a liquid ejection apparatus of the modification 1 of the first embodiment.
Figure 10:
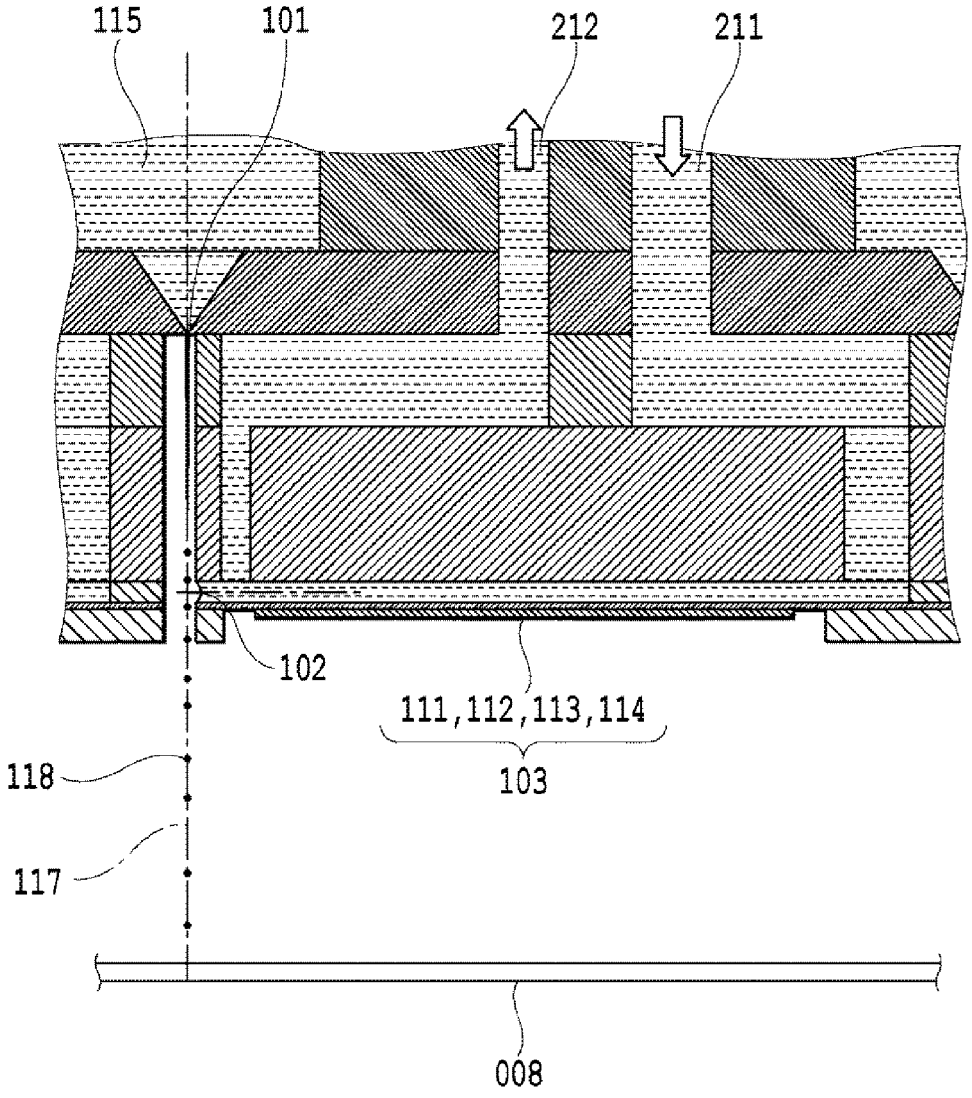
FIG. 10 is a cross-section of a liquid ejection head in accordance with a modification 2 of the first embodiment.

Another modification of the first embodiment of the present invention will now be explained. A schematic system diagram of the present modification is illustrated in FIG. 9, and a cross-section of a liquid ejection head is illustrated in FIG. 10. In the present modification, two collection channels to a collection nozzle 102 are provided, and liquid is made to flow continuously from the first collection channel 211 (supply channel for collection) to the second collection channel 212 (discharge channel).

Herein, take P1 to be the set pressure of a first collection pump 201, P2 to be the set pressure of a second collection pump 202, P3 to be the pressure of a collection nozzle 102, R1 to be the channel resistance of the first collection channel 211 from the first collection pump 201 to the collection nozzle 102, R2 to be the channel resistance of the second collection channel 212 from the second collection pump 202 to the collection nozzle 102, and Q to be the circulating flow volume. Given the above, the following two formulas are established.

$$Q=(P1-P2)/(R1+R2) \quad (1)$$

$$P3=(P1R2-P2R1)/(R1+R2) \quad (2)$$

If the above two formulas are combined, P1 and P2 are respectively solved for as follows.

Eq. 1

$$P_1 = \frac{R_1 + R_2}{R_2 - R_1}(P_3 - QR_1) \quad (3)$$

Eq. 2

$$P_2 = \frac{R_1 + R_2}{R_2 - R_1}(P_3 - QR_2) \quad (4)$$

By suitably setting pressures for the first collection pump 201 and the second collection pump 202 in accordance with Eqs. 3 and 4, it is possible to obtain a desired circulation flow volume while maintaining a meniscus at a collection nozzle 102. Specific numerical values of Q and P3 for a single nozzle may be approximately Q=2×10-9 m3/s and P3=−1.4 kPa (based on atmospheric pressure), for example.

By continuously circulating collection liquid as in the present modification, it is possible to prevent foreign matter from accumulating near a collection nozzle 102 and collection ink from thickening without properly circulating. It is also possible to prevent ink from being stuck near a collection nozzle 102 and improve fluidity by making the liquid supplied to the first collection channel 211 be dilute solution or diluted ink.

(Modification 3)

Figure 11:
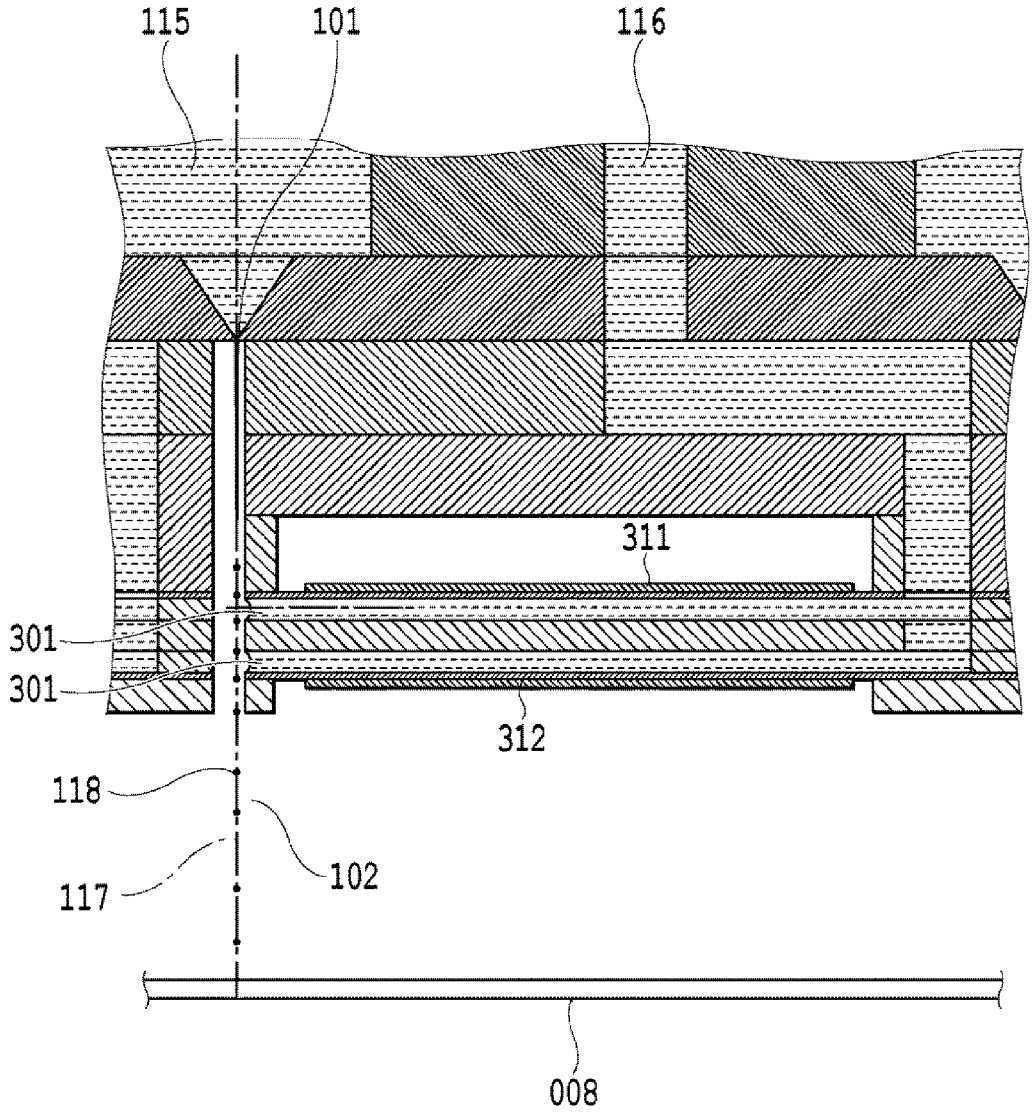
FIG. 11 is a cross-section of a liquid ejection head in accordance with a modification 3 of the first embodiment.

Another modification of the first embodiment of the present invention will now be explained. In the present modification, high-speed printing is accommodated by providing a plurality of collection nozzles with respect to a single ejection nozzle. A cross-section of a liquid ejection head of the present modification is illustrated in FIG. 11. A first collection nozzle 301 and a second collection nozzle 302 are positioned with respect to an ejection nozzle 101. The liquid surfaces of the first collection nozzle 301 and the second collection nozzle 302 are independently driven by a first liquid surface driving mechanism 311 and a second liquid surface driving mechanism 312, respectively. By having the respective collection nozzles collect unused droplets in alternation, it is possible to reliably conduct sorting in the case of raising the frequency of the vibrating mechanism 003 and conducting high-speed printing.

Second Embodiment

Figure 12:
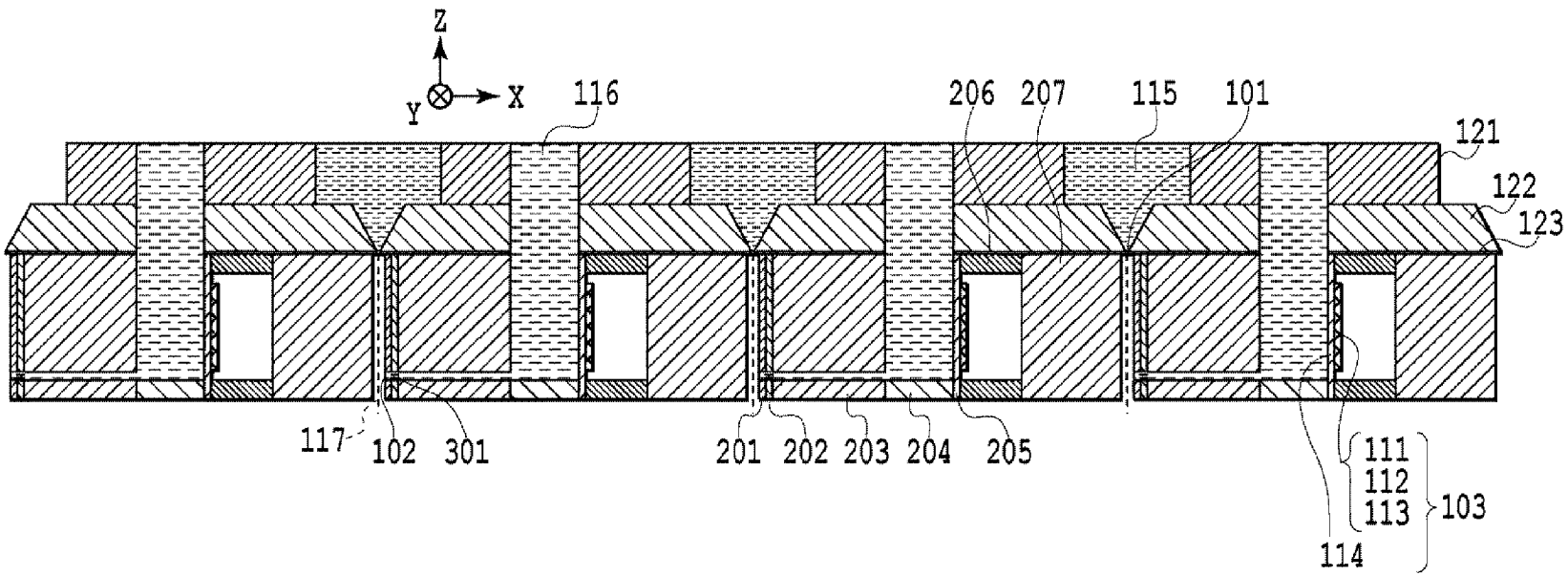
FIG. 12 is a cross-section of a liquid ejection head of a second embodiment of the present invention.
Figure 13A:
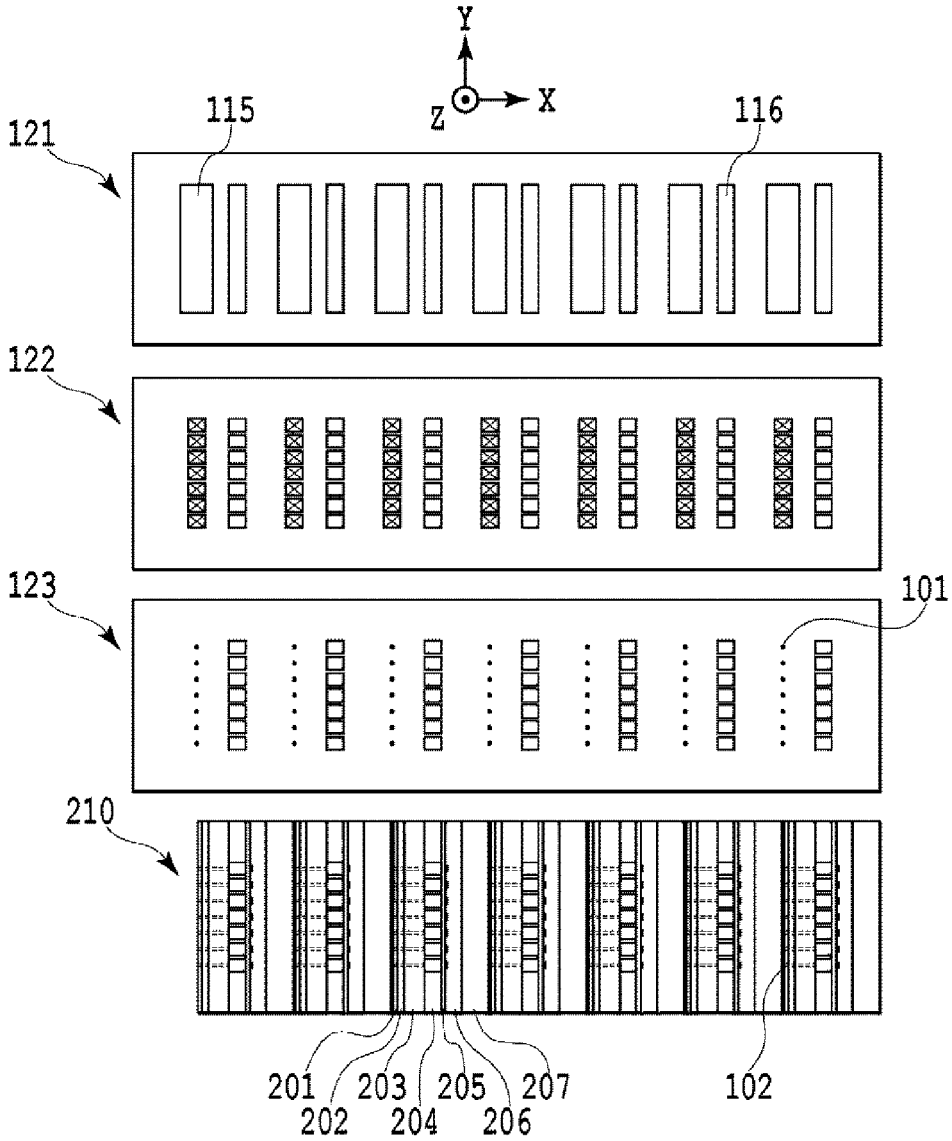
FIG. 13A is an exploded view of a liquid ejection head of the second embodiment.
Figure 13B:
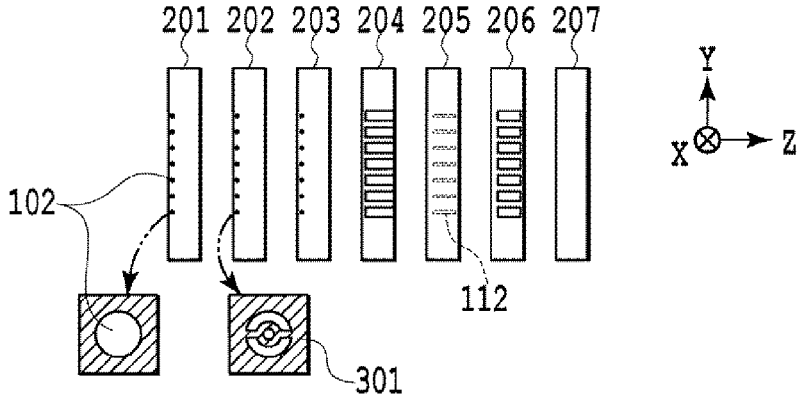
FIG. 13B is an exploded view of the collection channel unit in the head in FIG. 13A.

Next, a second embodiment of the present invention will be explained. A schematic system diagram of a liquid ejection apparatus of the present embodiment is similar to the first embodiment. FIG. 12 is a cross-section of a liquid ejection head in accordance with the present embodiment. FIG. 13A is a plan view of respective component members of the head. FIG. 13B illustrates respective component members of a collection channel unit. In the present embodiment, a two-dimensional multi-nozzle head configuration is indicated, with nozzle lines formed in the Y direction and respective nozzle lines arranged along the X direction.

As illustrated in FIG. 12, a liquid surface driving mechanism 103A is provided adjacent to a collection channel 116 that communicates with a collection nozzle 102, and it is possible to project a liquid surface of liquid inside the collection nozzle 102 out from the tip aperture of the collection nozzle 102. A liquid surface projecting from a collection nozzle 102 is disposed at a position along a flight trajectory 117 of droplets continuously ejected from an ejection nozzle 101.

As illustrated in FIGS. 12 and 13A, the head is made up of stacked planar members. A supply channel plate 121 that forms ejection ink supply channels 115, an individual channel plate 122 that forms tapered channels corresponding to individual nozzles, and an ejection nozzle plate 123 that forms ejection nozzles 101 are stacked in the Z direction, the same as the droplet flight trajectories. Collection channel units 210 are stacked and formed in the X direction orthogonal to the droplet flight trajectories, and aligned with the ejection nozzle plate 123.

Figure 14A:
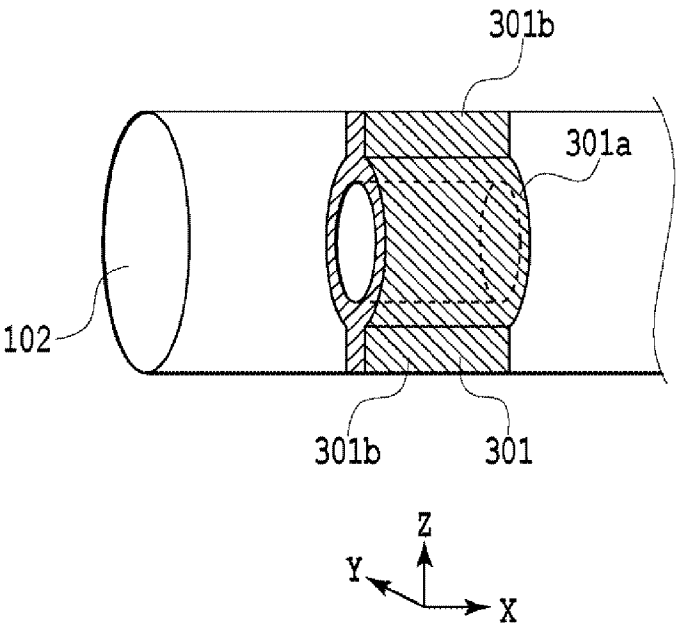
FIG. 14A illustrates a collection nozzle of a liquid ejection head of the second embodiment.
Figure 14B:
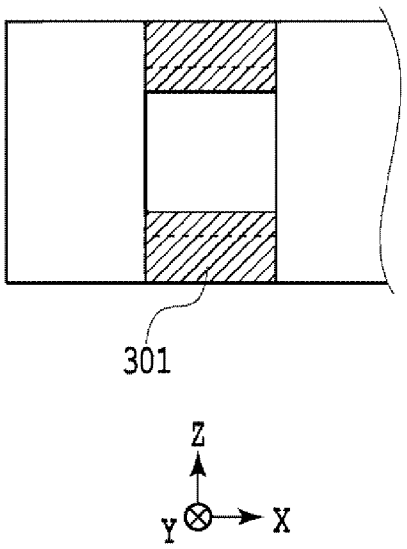
FIG. 14B illustrates a collection nozzle of a liquid ejection head of the second embodiment.
Figure 14C:
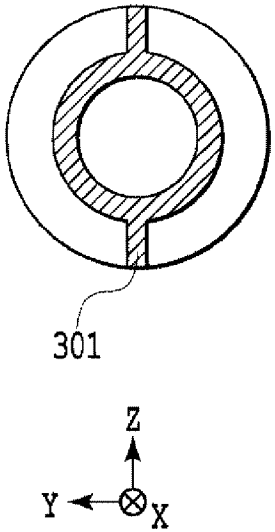
FIG. 14C illustrates a collection nozzle of a liquid ejection head of the second embodiment.

As illustrated in FIG. 13B, by stacking a flow rate restriction structure plate 202 between a collection nozzle plate 201 and a collection channel plate 203, a flow rate restriction structure 301 is provided along the channels inside the collection nozzles 102. The collection channels have pressure chambers made up of the vibrating plate 114 and the piezoelectric elements 112, which drive the liquid surfaces in the collection nozzles. Herein, a configuration of a collection nozzle 102 equipped with the double-walled cylinder flow rate restriction structure 301 illustrated in FIGS. 14A to 14C is given. Herein, although the flow rate restriction structure 301 is formed by the flow rate restriction structure plate 202 while the collection nozzle plate 201 and collection channel plate 203 are made up of separate members, the above may also be the same member.

Silicon, stainless steel, resinous materials, etc. may be used for these stacked members. By manufacturing these planar members by photolithographic patterning, etching, or pressing, the planar members can be processed all at once and the number of parts is not increased, even in the case of increasing the number of nozzles, and a head can be manufactured at low cost. In the present embodiment, thin-film piezo-electric elements are used as the liquid surface driving mechanism 103A. More specifically, a configuration is realized wherein upper electrodes 111, piezoelectric elements 112, and lower electrodes 113 are deposited on top of the vibrating plate 114. Sputtering, etc. may be used for deposition, or dry etching may be used for patterning.

In FIG. 13B, the nozzle spacing in the Y direction is, for example, 500 μm, and the nozzle spacing in the X direction is 3 mm. Liquid having a viscosity of 1 cP to 40 cP and a surface tension of 30 mN/m may be used. For example, in the case of 40 cP ink, if the diameter of an ejection nozzle 101 is taken to be 7.4 μm, the pressure of the pressure pump 002 to be 0.8 MPa, and the vibrational frequency of the vibrating mechanism 003 to be 50 kHz, then the droplet size is 4 pL (diameter approximately 20 μm) and the ejection velocity is approximately 10 m/s.

FIGS. 14A to 14C illustrate a channel structure inside a collection nozzle 102 of the present embodiment. FIG. 14A is a perspective view, FIG. 14B is a cross-section, and FIG. 14C is a lateral view as viewed from the side of a collection nozzle 102. In FIGS. 14A to 14C, a liquid surface projects out in the minus X direction. As illustrated in FIGS. 14A to 14C, the flow rate restriction structure 301 is provided at a position distanced from the aperture surface of the collection nozzle 102 by a distance equal to or greater than the radius of the collection nozzle 102.

The flow rate restriction structure 301 is provided, for example, at a position receded from the aperture of an approximately ϕ80 μm collect ion nozzle 102 by approximately 50 μm towards the channel. The flow rate restriction structure 301 is provided with a cylinder unit 301*a* approximately 50 μm in length and a support unit 301*b* projecting outward in order to support the cylinder unit 301*a*. The cylinder unit (cylindrical unit) 301*a* is provided in a concentric fashion on the collection nozzle 102. Herein, the disposed position of the cylinder unit 301 a is preferably distanced from the aperture of the second nozzle 102 by a distance that is at least greater than the aperture's inner radius of 40 μm.

Figure 15A:
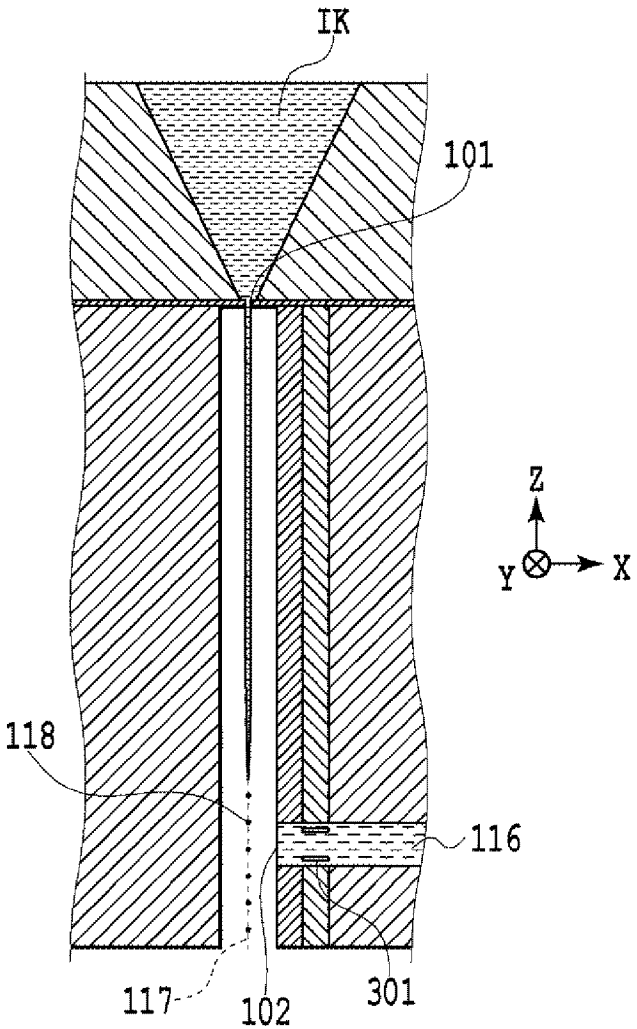
FIG. 15A is a cross-section for explaining operation of a liquid ejection head of the second embodiment.

Next, operation of a liquid ejection apparatus in accordance with the present embodiment will be explained with reference to FIGS. 15A and 15B. The diameter of a collection nozzle 102 is approximately 80 μm, for example, and is provided at a point distanced from an ejection nozzle 101 by approximately 1 mm in the droplet flight direction.

Ink IK stored in an ink tank 001 is pressurized by a pressure pump 002 and supplied to a head 004. Vibration is applied to the ink IK supplied to the head 004 by a vibrating mechanism 003, and a liquid column is ejected from an ejection nozzle 101. Once the ink ejected from the ejection nozzle 101 reaches a position approximately 500 μm to 800 μm away, a droplet separates from the liquid column and flies along a droplet flight trajectory 117 indicated by the chain line. Due to air resistance, the ejected droplet decelerates to approximately 8 m/s when passing through the vicinity of a collection nozzle 102. Also, the droplet flight trajectory 117 is distanced from the collection nozzle 102 by 30 μm. Meanwhile, at the collection nozzle 102, negative pressure by a collection pump 006 (as much as −1.4 kPa based on atmospheric pressure) and meniscus force are balanced, thereby causing a liquid surface to be held near the aperture of the collection nozzle 102, as illustrated in FIG. 15A.

Figure 15B:
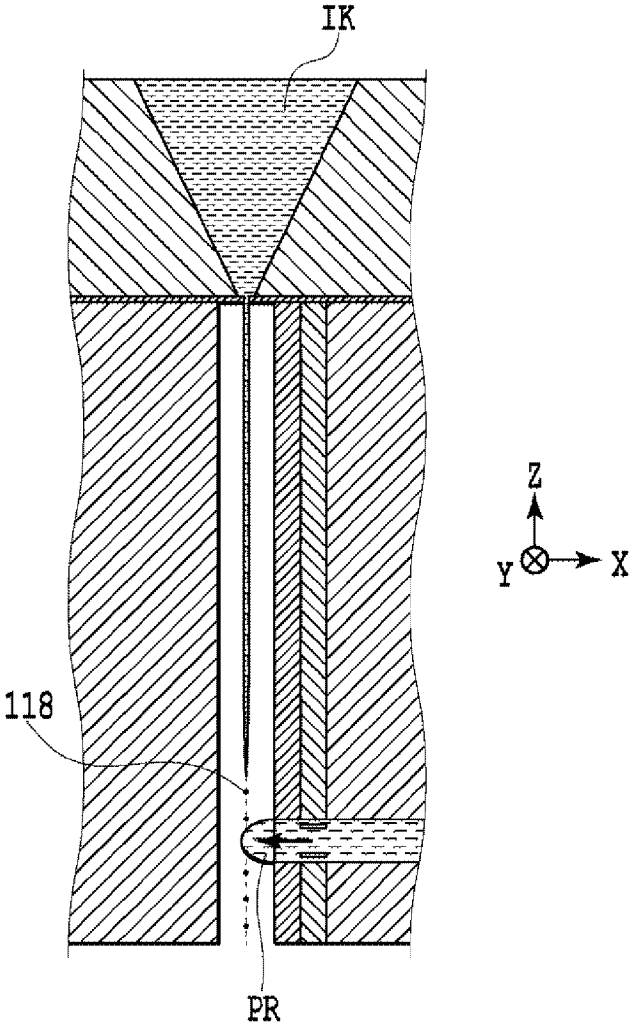
FIG. 15B is a cross-section for explaining operation of a liquid ejection head of the second embodiment.

When a droplet not used for printing (unused droplet) 118 passes through the vicinity of the collection nozzle 102, a signal from a controller 005 causes a liquid surface driving mechanism 103A to project a liquid surface out from the aperture of the collection nozzle 102 at a position along the droplet flight trajectory 117, as illustrated in FIG. 15B. Then, by causing the flying unused droplet 118 to collide with the projected liquid surface PR projecting from the aperture of the collection nozzle 102, the unused droplet 118 is captured.

After that, the unused droplet 118 unites with the projected liquid surface PR, and the projected liquid surface PR returns to its original stasis position by surface tension. By keeping the pressure constant with the collection pump 006, the liquid surface of the collection nozzle 102 is still kept at a constant position after capture. Particularly, the magnitude of displacement by the liquid surface driving mechanism 103A is controlled so that the projected liquid surface PR does not form droplets. Captured droplets are gradually sent to an ink adjuster 007, subjected to foreign matter removal and viscosity adjustment, then once again pressurized by the pressure pump 002 and recirculated into the head 004 for reuse. Meanwhile, when a droplet used for printing (used droplet) passes through the vicinity of the collection nozzle 102, the liquid surface of the collection nozzle 102 is not made to project out (advance) and intersect the droplet flight trajectory 117. In so doing, the used droplet proceeds directly to land on a print medium 008.

As discussed above, by controlling the liquid surface driving mechanism 103A according to print data, droplets not used for printing can be collected by a projected liquid surface, and only droplets used for printing can be made to land on a print medium 008. Herein, a desired image can be printed by holding a print medium with conveying unit (not illustrated) and conveying the print medium in coordination with droplet ejection timings.

In the case of conducting high-speed printing, the next droplet may pass through before the liquid surface of a collection nozzle 102 has fully returned to its stasis position. However, even in such cases, if unused droplet capture and used droplet passage are conducted with a sufficient differential in position between when the liquid surface of a collection nozzle 102 is advanced and when it is retreated, a liquid ejection apparatus of the present invention will normally function. In other words, by providing a structure near the aperture of a second nozzle and restricting the flow of liquid, the magnitude of displacement in a liquid surface projected from the second nozzle can be increased, and used droplets can be sorted out from unused droplets even when driving at high frequency. In the present embodiment, a (flow rate restriction) structure 301 that restricts flow in an area between a central nozzle area and inner nozzle perimeter is disposed inside a collection nozzle 102. In so doing, a sufficient differential in position between when the liquid surface of a collection nozzle 102 is advanced and when it is retreated can be acquired.

The present embodiment is discussed for the case where negative pressure is maintained by a collection pump 006 and a liquid surface at a collection nozzle 102 is made to retreat, and when an unused droplet passes through, the liquid surface is made to advance by a liquid surface driving mechanism 103A. In contrast, it may also be configured such that positive pressure is maintained by a collection pump 006 and a liquid surface at a collection nozzle 102 is made to advance, and when a used droplet passes through, the liquid surface is made to retreat by a liquid surface driving mechanism 103A. In this case, the outer surface of a collection nozzle 102 is preferably processed to be water-repellent and configured such that the liquid surface does not spill and spread out over the outer surface while in a state of applied positive pressure. This method is effective at reducing power consumption and heat while in a state where printing is not being conducted and all ejected ink is being collected, such as during standby.

In FIG. 12, the liquid surface driving mechanism 103A uses piezoelectric elements on a thin film, but the driving means of other methods may also be used. For example, in the case of piezoelectric elements, bulk piezoelectric elements may be stacked and used, or piezoelectric elements may be used laterally and deformation in the d15 direction may be used (shear mode). Alternatively, a heater may be used as the driving means and the liquid surface may be driven by bubble formation due to film boiling. In the case of using a heater, a large displacement is easily obtained and the configuration can be made more compact compared to the case of using piezoelectric materials, thus making higher nozzle densities possible. On the other hand, in the case of using piezo-electric elements, liquid surface control can be precisely conducted by optimizing the driving waveform.

Next, the results of using general-purpose fluid analysis software to analyze operation of a liquid surface projected from a collection nozzle 102 in the present embodiment will be explained.

Ink viscosity was taken to be 40 cP, surface tension to be 30 mN/m, an d a sinusoidal waveform displacement of ±20 nm at 50 kHz was applied to a contact point as motion equivalent to a liquid surface driving mechanism 103A.

Figure 16:
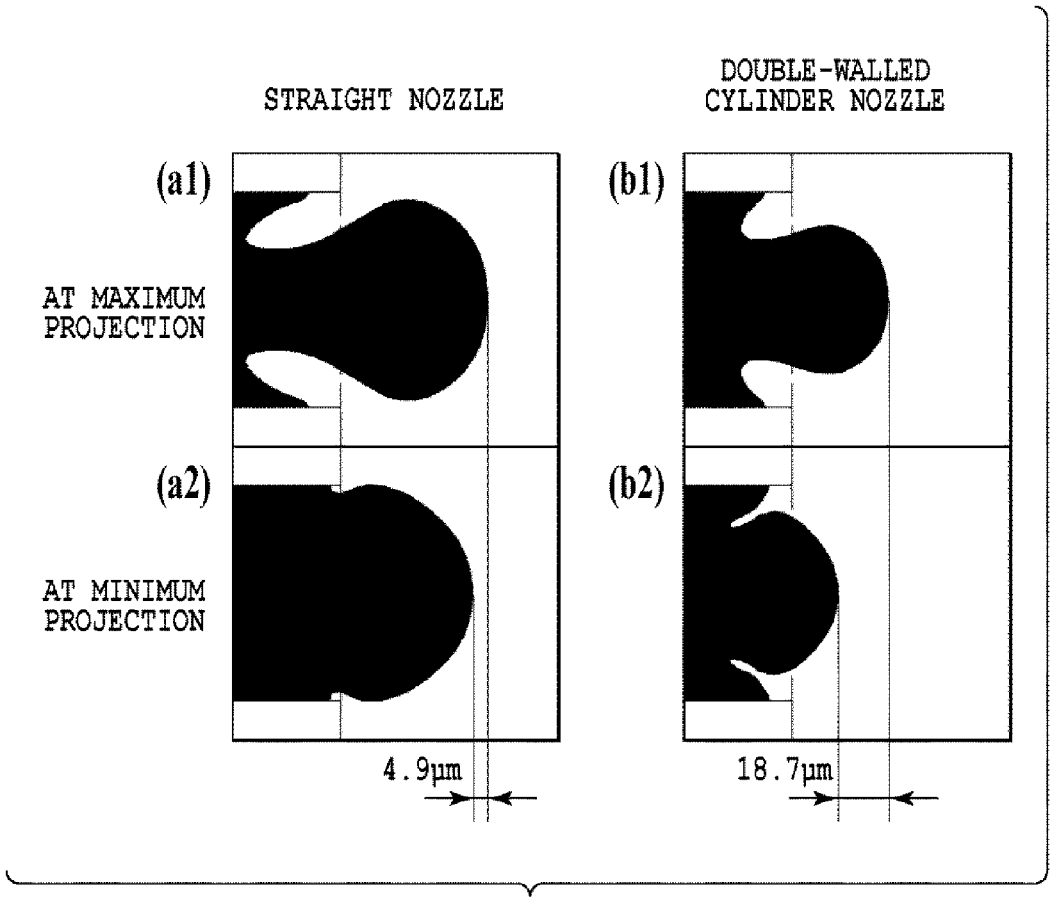
FIG. 16 illustrates simulation results for the operation of a liquid ejection apparatus of the second embodiment.

FIG. 16 illustrates the simulation results. Motion of the liquid surf ace of a collection nozzle 102 is illustrated, with (a1) and (a2) in FIG. 16 being the analysis results for a straight nozzle with no flow rate restriction structure 301, and with (p1) and (b2) in FIG. 16 being the analysis results for a nozzle provided with a flow rate restriction structure 301. Whereas the differential between advance and retreat of the liquid surface is 4.9 μm for a straight nozzle, the differential increases to 18.7 μm for a nozzle provided with a double-walled cylinder flow rate restriction structure 301, thus demonstrating its advantages.

Figure 17:
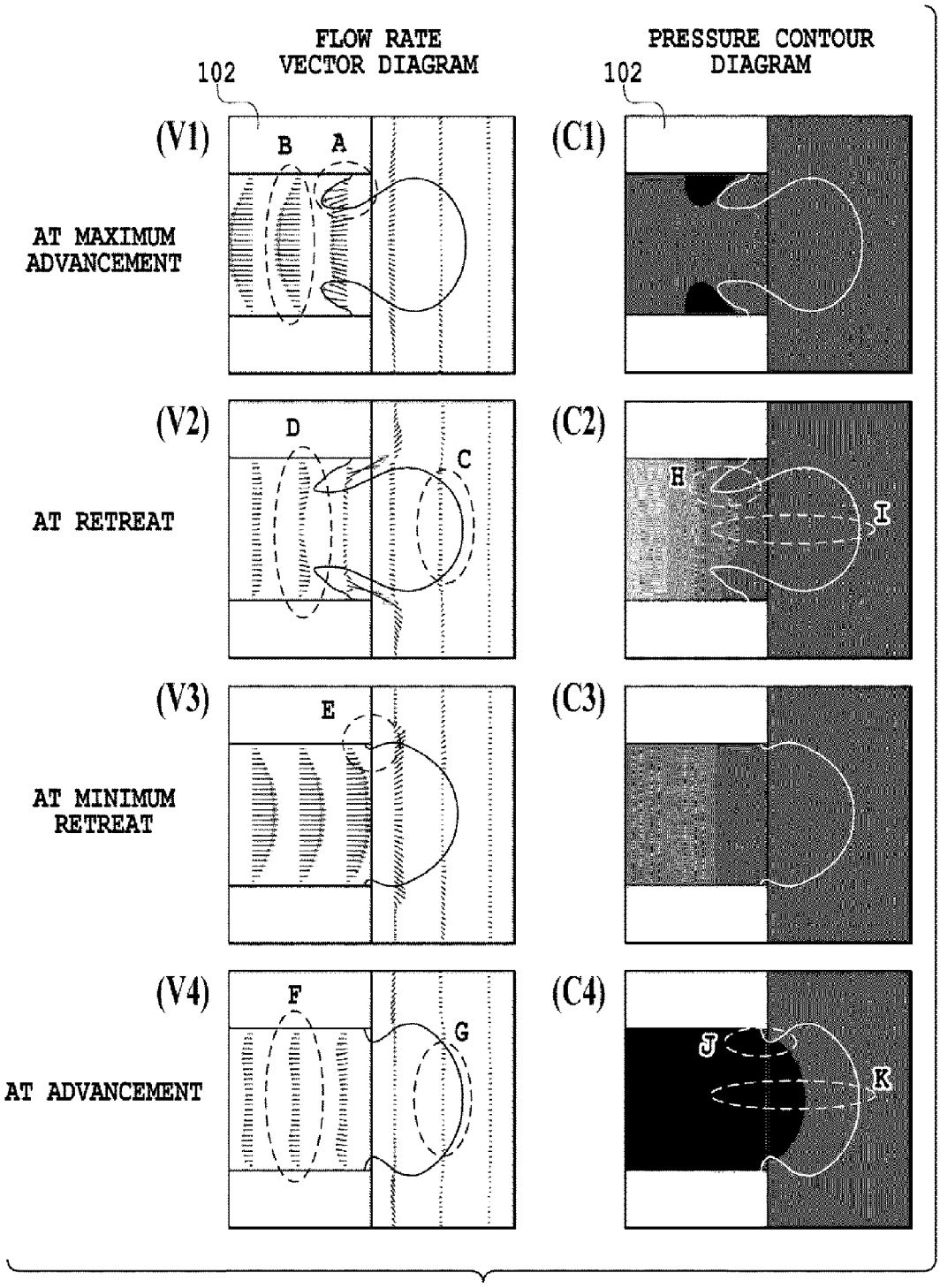
FIG. 17 illustrates simulation results for when using a straight nozzle.

The behavior of these liquid surfaces is described in further detail below. FIG. 17 illustrates flow rate vector diagrams and pressure contour diagrams for the straight nozzle simulation results. In FIG. 17, a liquid surface advances to the right. Also, in the pressure contour diagrams, lighter colors indicate higher pressures.

First, at maximum advancement ((V1) in FIG. 17), the liquid surface greatly retracts near the inner peripheral wall surface (see the broken ellipse A in FIG. 17), and the flow rate inside the channel is in the direction causing the liquid surface to retreat (see the broken ellipse B in FIG. 17). When the liquid surface retreats ((V2) in FIG. 17), the flow rate near the center of the liquid surface is extremely low (see the broken ellipse C in FIG. 17). FIG. 17 also demonstrates that the flow rate inside the channel has already reversed to the advancement direction, and the flow rate near the inner peripheral wall surface has become greater than in the center (see the broken ellipse D in FIG. 17).

When the center of the projected liquid surface is at minimum retreat ((V3) in FIG. 17), the liquid surface near the inner peripheral wall surface that had been retracted is now returning to near the aperture of the collection nozzle 102 (see the broken ellipse E in FIG. 17). When the center of the projected liquid surface begins to advance ((V4) in FIG. 17), the flow rate inside the channel points in the retreating direction, and the flow rate near the inner peripheral wall surface becomes faster than in the center (see the broken ellipse F in FIG. 17). The flow rate near the center of the projected liquid surface is extremely small at this time, too (see the broken ellipse G in FIG. 17).

The above demonstrates that while motion of the liquid surface near the inner peripheral wall surface of a collection nozzle 102 follows changes in the flow rate inside the channel, motion at the center of the liquid surface is delayed, and the phase of both motions is out of sync. Also, while the magnitude of displacement at the center of the liquid surface is small, the magnitude of displacement in the liquid surface near the inner peripheral wall surface is large, and almost all of the energy of a liquid surface driving mechanism 103A is expended near the inner peripheral wall surface of a collection nozzle 102.

Consider the cause of the large magnitude of displacement in the liquid surface near the inner peripheral wall surface of the collection nozzle 102 from the pressure gradient. From the pressure contour diagram during liquid surface retreat ((C2) in FIG. 17), the pressure gradient near the inner peripheral wall surface is large (see the broken ellipse H in FIG. 17), while the pressure gradient near the center is small (see the broken ellipse I in FIG. 17). This demonstrates that the energy of the liquid surface driving mechanism 103 is expended as energy moving the liquid surface near the inner peripheral wall surface before moving the liquid surface at the center. The pressure contour during liquid surface projection ((C4) in FIG. 17) is similar, demonstrating that the pressure gradient near the inner peripheral wall surface is large (see the broken ellipse J in FIG. 17), while the pressure gradient near the center is small (see the broken ellipse K in FIG. 17).

Figure 18:
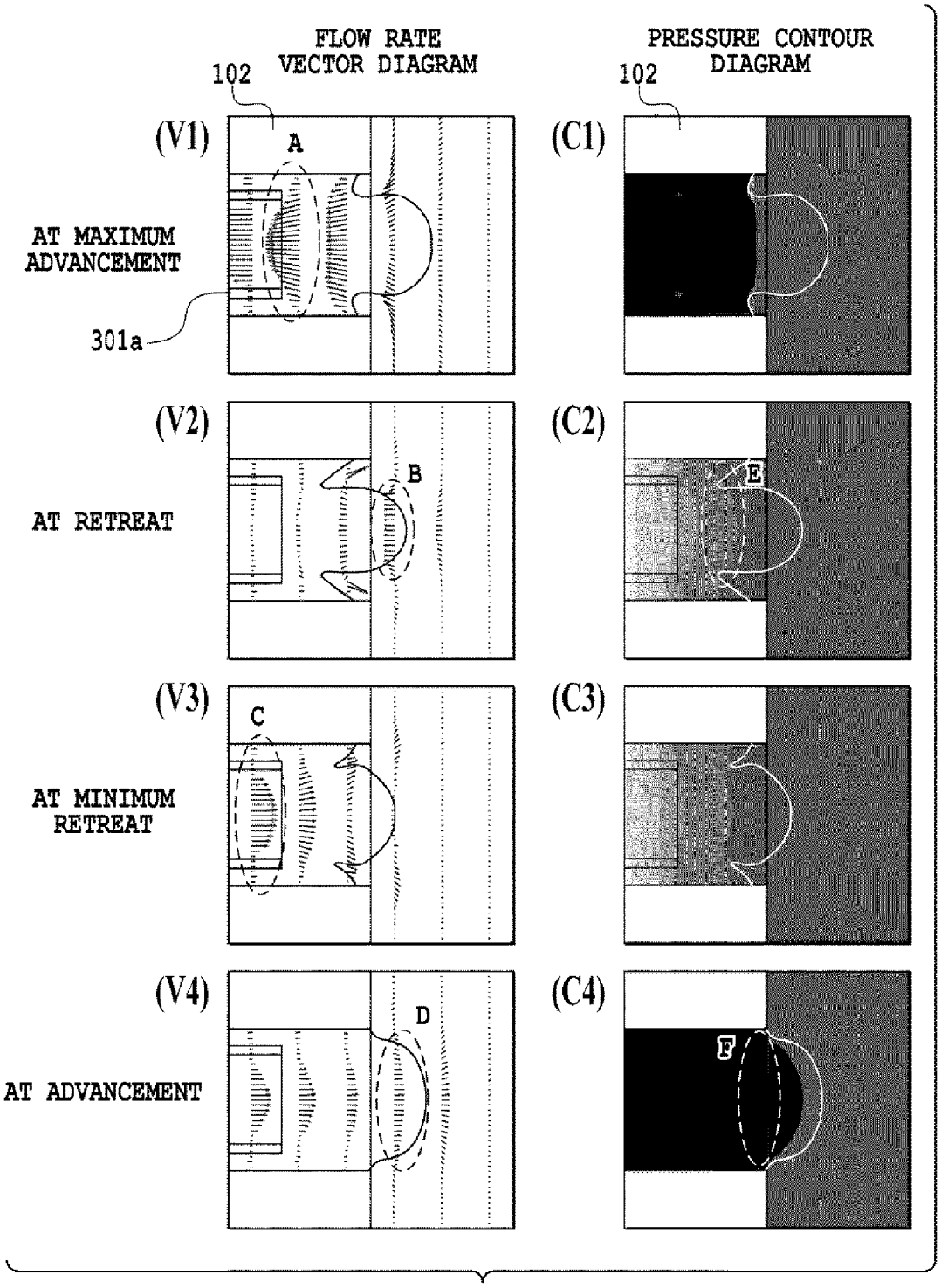
FIG. 18 illustrates simulation results for when using a collection nozzle of the second embodiment.

FIG. 18 illustrates flow rate vector diagrams and pressure contour diagrams for the simulation results of a double-walled cylinder collection nozzle provided with a flow rate restriction structure 301 of the present embodiment.

First, at maximum advancement ((V1) in FIG. 18), the flow rate is fast at the center due to the effects of the flow rate restriction structure 301, while the flow rate near the inner peripheral wall surface is suppressed (see the broken ellipse A in FIG. 18). When the liquid surface retreats ((V2) in FIG. 18), the flow rate in the retreating direction increases at the center of the projected liquid surface near the center of the liquid surface (see the broken ellipse B in FIG. 18).

When the center of the projected liquid surface is at minimum retreat ((V3) in FIG. 18), the flow rate in the channel center becomes faster (see the broken ellipse C in FIG. 18). When the center of the projected liquid surface begins to advance ((V4) in FIG. 18), the flow rate in the advancing direction at the center of the liquid surface becomes faster (see the broken ellipse D in FIG. 18).

The above demonstrates that both the motion of the liquid surface near the inner peripheral wall surface and the motion of the liquid surface at the center follow the motion of the flow rate inside the channel of a collection nozzle 102, and the phase differential between the motions is smaller compared to that of the straight nozzle described above. Also, the magnitude of displacement in the liquid surface near the inner peripheral wall surface of a collection nozzle 102 is suppressed, and accordingly, the magnitude of displacement at the center is increased. This is because the flow rate distribution inside the channel of a collection nozzle 102 has a large peak due to the action and effects of a flow rate restriction structure 301.

Also, from the pressure contour during liquid surface retreat ((C2) in FIG. 18), the pressure distribution at the center takes a shape that bulges in the advancing direction (see the broken ellipse E in FIG. 18), and the pressure gradient near the center of the liquid surface is larger compared to the case of a straight nozzle. The pressure contour during liquid surface advancement ((C4) in FIG. 18) is similar, with the pressure distribution at the center taking a shape that bulges in the advancing direction (see the broken ellipse F in FIG. 18).

As explained above, a flow rate restriction structure 301 disposed in a collection nozzle 102 relatively reduces the flow rate and pressure gradient near the inner peripheral wall surface compared to the case of no (flow rate restriction) structure 301, and acts to relatively increase the flow rate and pressure gradient at the center. Also, since a flow rate restriction structure 301 reduces the operational phase differential with a liquid surface driving mechanism 103A to a small value, energy loss becomes smaller, and the position differential between the advance and retreat of a projected liquid surface (the magnitude of displacement) can be increased. In other words, by observing that the flow rate and pressure distribution of a liquid in the direction proceeding from a central area to an inner peripheral wall surface area near the aperture of a collection nozzle 102 is related to the magnitude of displacement in a projected liquid surface and controlling the flow rate and pressure distribution of the liquid with a flow rate restriction structure 301, the magnitude of displacement by a projected liquid surface can be increased.

In this way, by providing a flow rate restriction structure 301 in the channel inside a collection nozzle 102 so as to restrict flow between a central area and an inner peripheral wall surface area, displacement operation of a liquid surface at 50 kHz is achieved, and droplet selection is conducted to achieve desired printing.

Figure 19A:
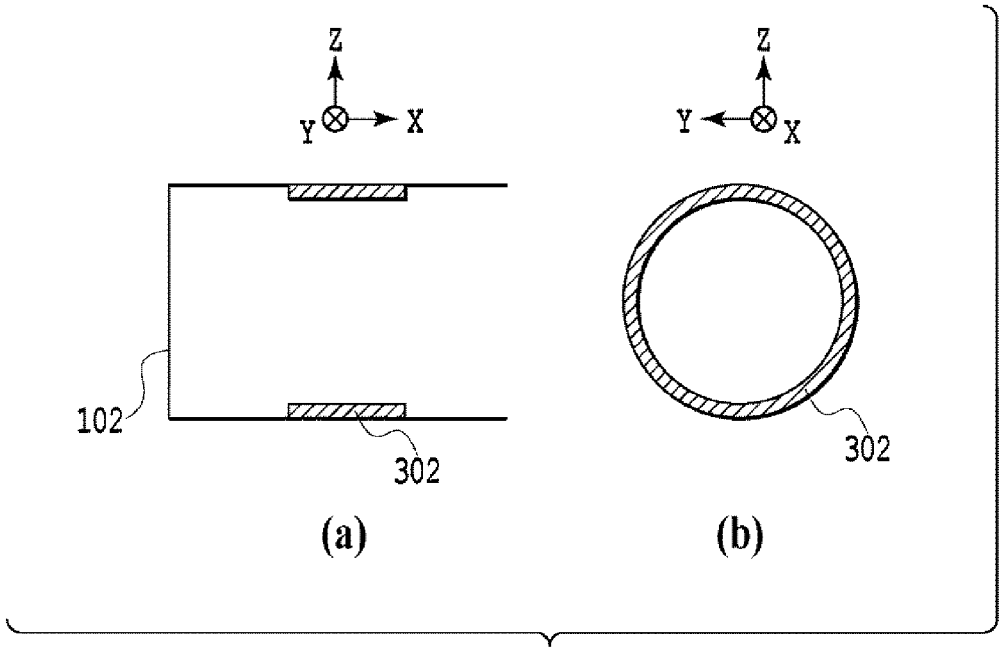
FIG. 19A illustrates modifications of a collection nozzle in accordance with the second embodiment.
Figure 19B:
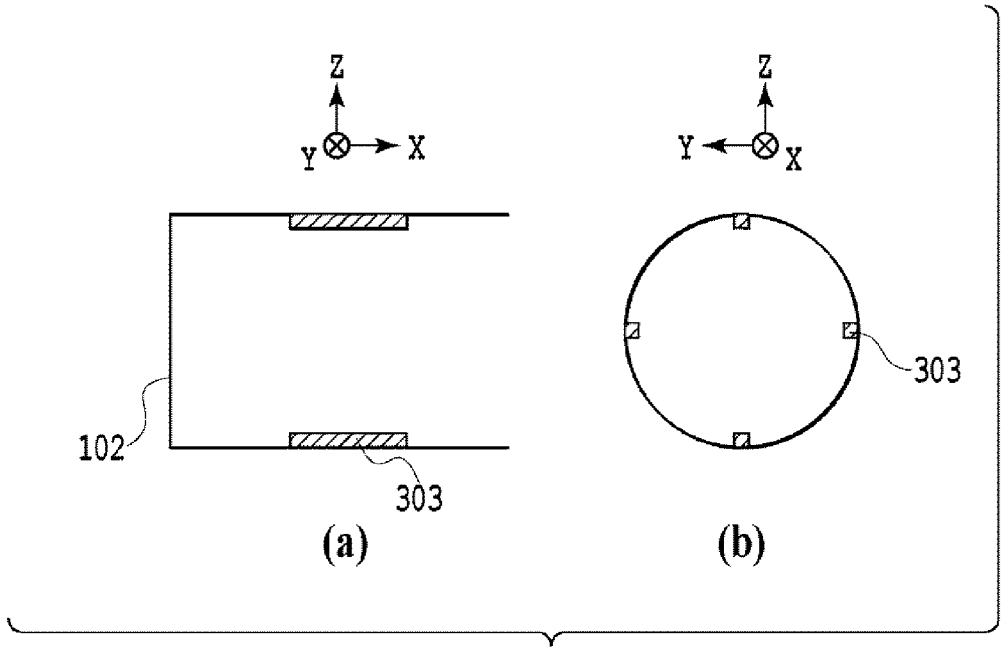
FIG. 19B illustrates modifications of a collection nozzle in accordance with the second embodiment.

Also, although the foregoing describes a double-walled cylinder configuration that splits the channel inside a collection nozzle 102 into a central area and an inner peripheral wall surface area, similar advantages can be obtained by providing structures 302 and 303 that act as flow resistors in the inner peripheral wall surface area, as illustrated in FIGS. 19A and 19B. The structure 302 is a ring-shaped member that fits against the inner peripheral wall surface of a collection nozzle 102. The structure 303 is a plurality of projecting members arranged along the circumference of the inner peripheral wall surface of a collection nozzle 102.

(Modification 1)

Figure 20:
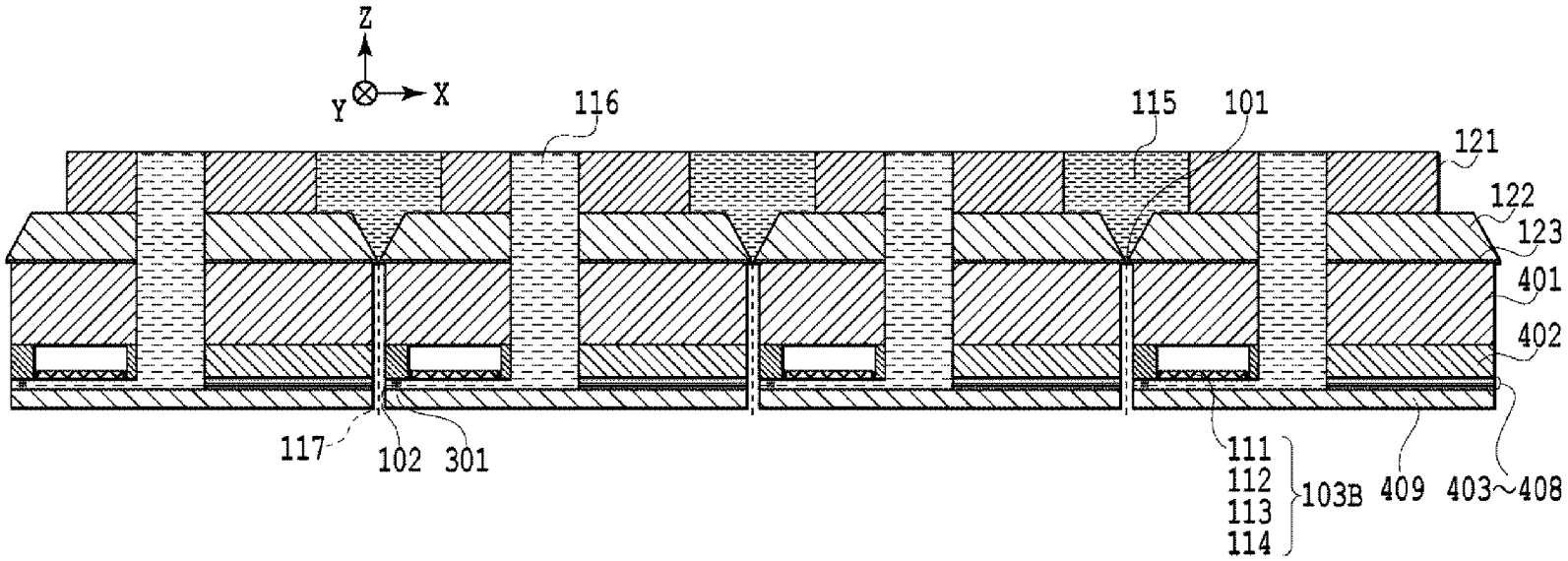
FIG. 20 is a cross-section of a liquid ejection head in accordance with a modification of the second embodiment.
Figure 21:
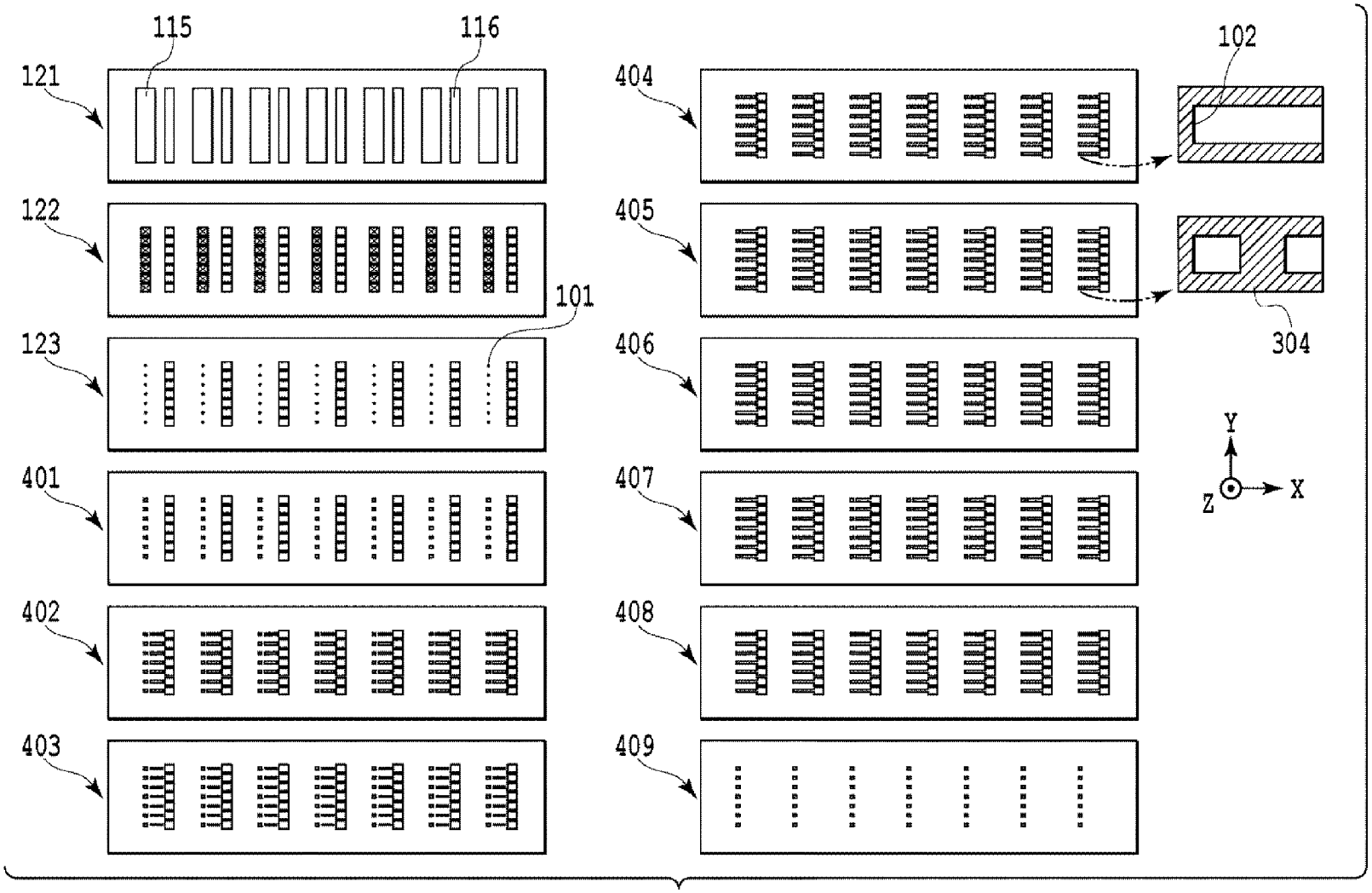
FIG. 21 is an exploded view of the liquid ejection head in FIG. 20.

A modification of the second embodiment of the present invention will now be described. A cross-section of a liquid ejection head configuration in the present modification is illustrated in FIG. 20, and an exploded view is illustrated in FIG. 21. A flow rate restriction structure 304 in the channel inside a collection nozzle 102 in the present modification is structured as in FIGS. 22A to 22C. By configuring square nozzles and planar structures, the stacking directions all become the same Z direction, thus making manufacturing simpler.

As FIG. 20 demonstrates, all plates are stacked in the same Z direction as the droplet flight trajectory 117. Flow rate restriction structures 304 can be formed by alternately stacking collection channel plates (404, 406, 408) and flow rate restriction structure plates (405, 407) as illustrated in the exploded view in FIG. 21.

Herein it is configured such that flow rate restriction structures 304 are formed by flow rate restriction structure plates (405, 407) which are separate members from the collection channel plates, but these may also be configured as the same members.

Figure 22A:
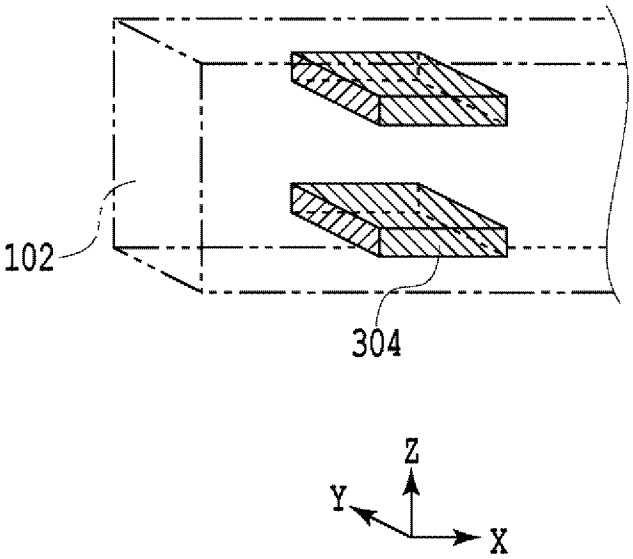
FIG. 22A illustrates the structure of a collection nozzle in the liquid ejection head in FIG. 20.
Figure 22B:
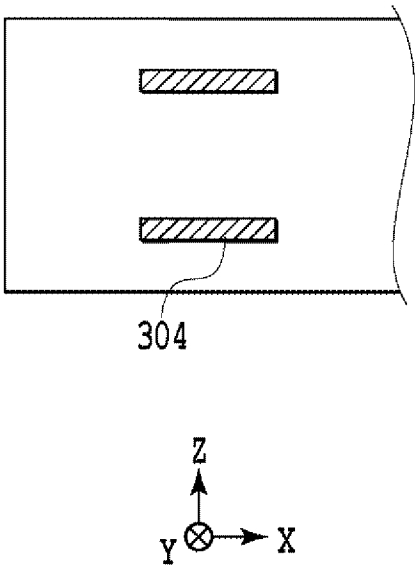
FIG. 22B illustrates the structure of a collection nozzle in the liquid ejection head in FIG. 20.
Figure 22C:
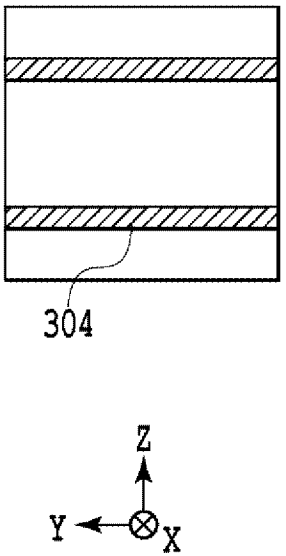
FIG. 22C illustrates the structure of a collection nozzle in the liquid ejection head in FIG. 20.

In FIG. 22A, the length of one side of the square shape of a collection nozzle 102 is 80 μm, with a flow rate restriction structure 304 disposed at a position receded from the aperture surface of the collection nozzle 102 by 50 μm.

In the present modification, liquid surface displacement operation is realized, and droplet selection is conducted to achieve desired printing.

In this way, advantages similar to those of the second embodiment described earlier are obtained by inserting a structure 304 that restricts flow at the inner peripheral wall surface, even though the structure 304 restricts flow on just two sides of a square nozzle.

Figure 23A:
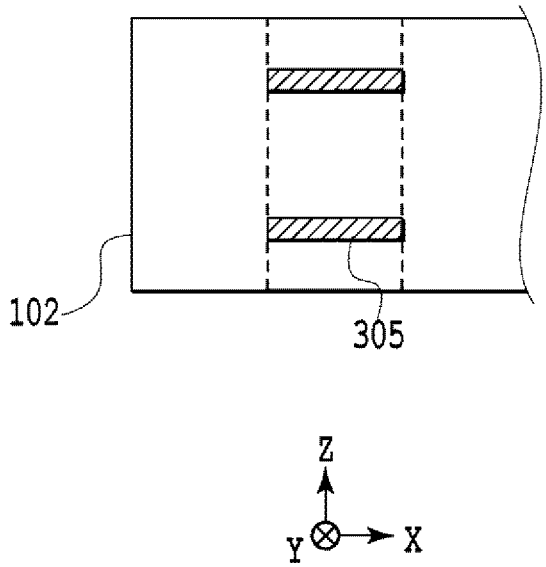
FIG. 23A illustrates another configuration of a collection nozzle in accordance with the second embodiment.
Figure 23B:
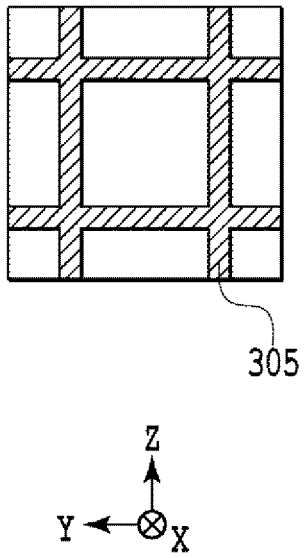
FIG. 23B illustrates another configuration of a collection nozzle in accordance with the second embodiment.

Also, similar advantages can be obtained with a similar manufacturing method by configuring a double-walled square cylinder 305 as illustrated in FIGS. 23A and 23B.

Various exemplary structures are explained in the above embodiment as a structure, but these are not limiting, and any structure is implementable as long as it is a structure able to control the flow rate and pressure distribution of a liquid such that the magnitude of displacement by a projected liquid surface can be increased.

Third Embodiment

Figure 24:
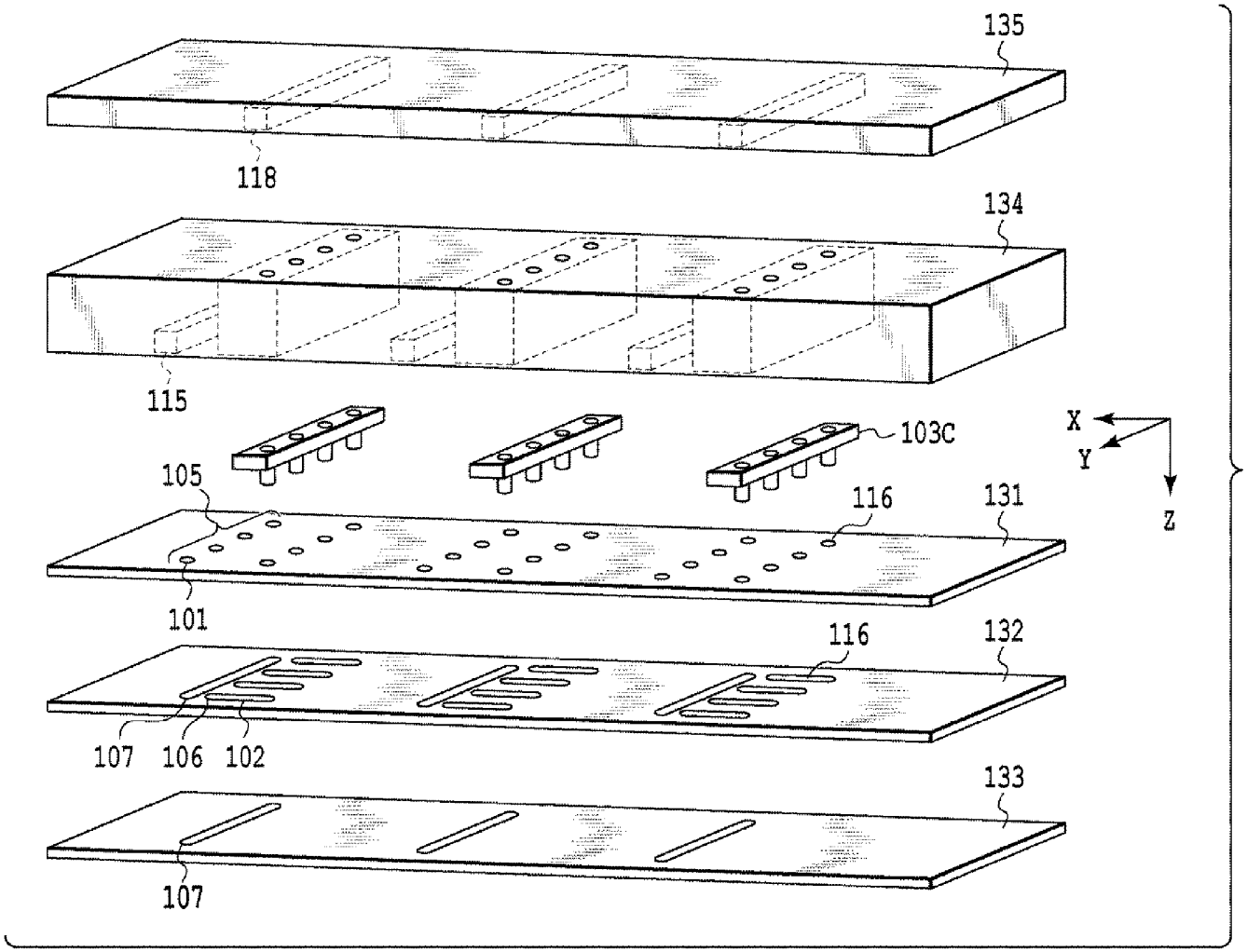
FIG. 24 is an exploded perspective view of a liquid ejection head in accordance with a third embodiment of the present invention.
Figure 25A:
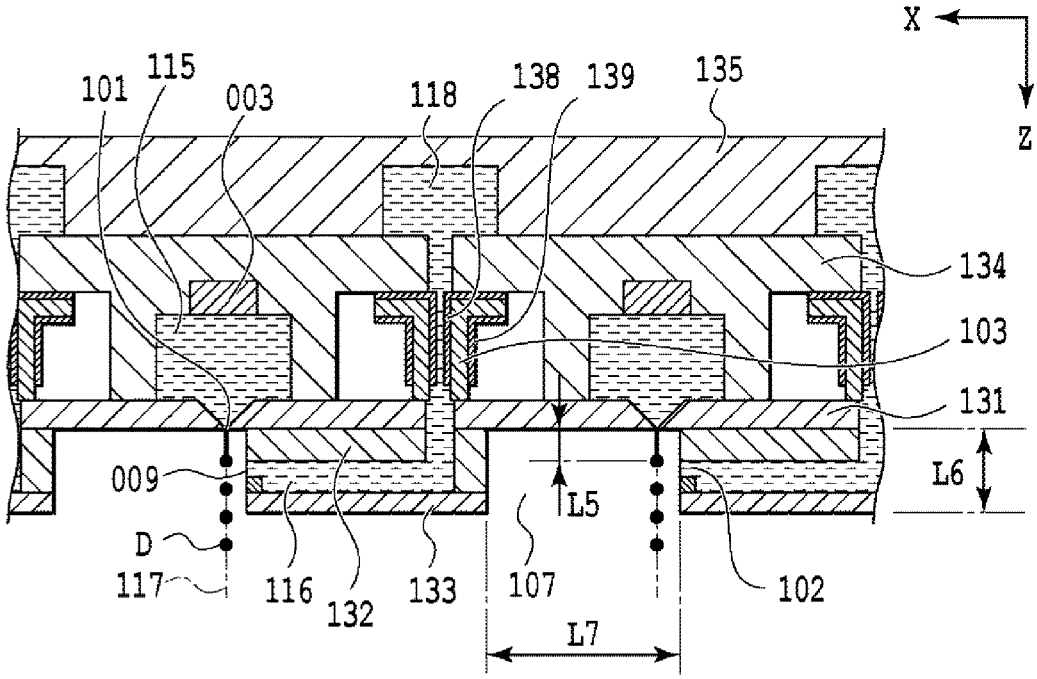
FIG. 25A is a cross-section of the liquid ejection head in FIG. 24.
Figure 25B:
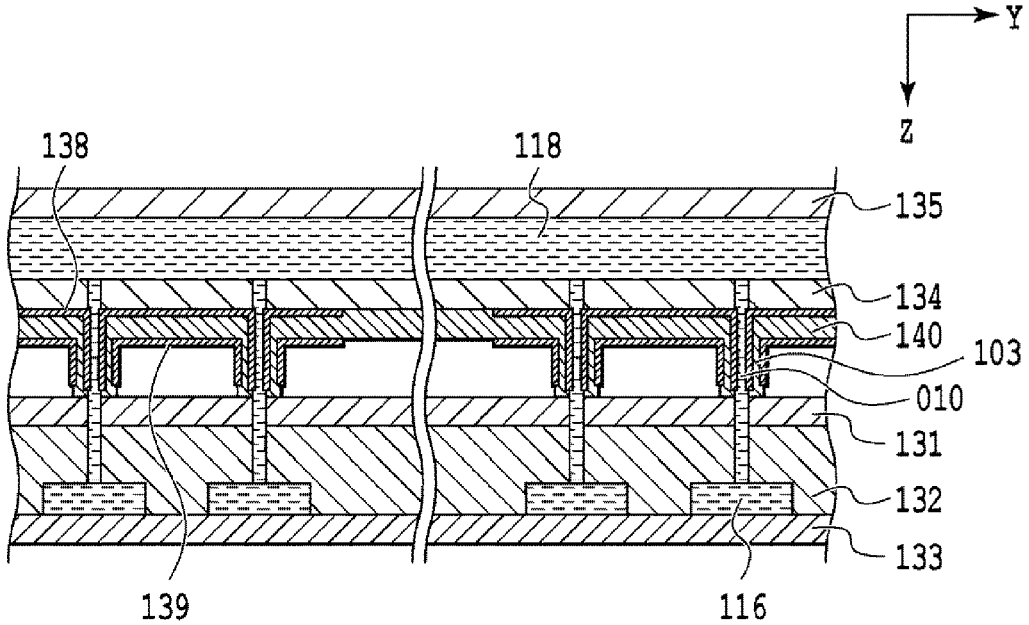
FIG. 25B is a cross-section of the liquid ejection head in FIG. 24.

Hereinafter, a third embodiment of the present invention will be explained with reference to the drawings. A system schematic of a liquid ejection apparatus of the present embodiment is similar to the first embodiment. FIG. 24 is an exploded perspective view of a liquid ejection head in accordance with the present embodiment. FIGS. 25A and 25B are cross-sections of the liquid ejection head in FIG. 24. Similarly to the above embodiments, the liquid ejection head is provided with ejection nozzles 101, supply channels 115, a vibrating mechanism 003, collection nozzles 102, and a liquid surface driving mechanism 103C. As illustrated in FIG. 25A, the vibrating mechanism 003 is disposed along a channel farther upstream than an ejection nozzle 101. In the present embodiment for example, the vibrating mechanism 003 is disposed along the supply channels 115 (i.e., disposed in the −Z arrow direction with respect to an ejection nozzle plate 131). By stacking a first collection channel member 132 and a second collection channel plate 133 on the ejection nozzle plate 131 in the Z arrow direction, there are formed collection nozzles 102, collection channels 116, and gutter-shaped droplet flight slits 107 for allowing droplets to fly. A collection nozzle 102 is disposed such that, by driving the liquid surface driving mechanism 103C, a sufficient projection magnitude of a liquid surface 009 is produced, given droplets continuously ejected from an ejection nozzle 101 collide and unite with the liquid surface 009, and can be collected inside the collection nozzle 102. Each collection channel 116 extends in the −Z arrow direction while cutting across the ejection nozzle plate 131, and is coupled with the liquid surface driving mechanism 103C. A number of collection channels 116 equal to the number of collection nozzle lines 106 (FIG. 24) converge at a downstream collection merge channel 118.

In the present embodiment, the liquid surface driving mechanism 103C is disposed on the side of the ejection nozzle plate 131 opposite to the collection nozzles. By disposing the liquid surface driving mechanism 103C in this way, the depth (L6) of the droplet flight slits 107 can be made shallower. More specifically, the position of a collection nozzle 102 in the Z arrow direction is brought closer to the ejection nozzle plate 131, up to the droplet formation distance (L5) where ink pushed out from an ejection nozzle 101 forms a droplet. Consequently, the depth (L6) of the droplet flight slits 107 is made shallower.

Figure 26:
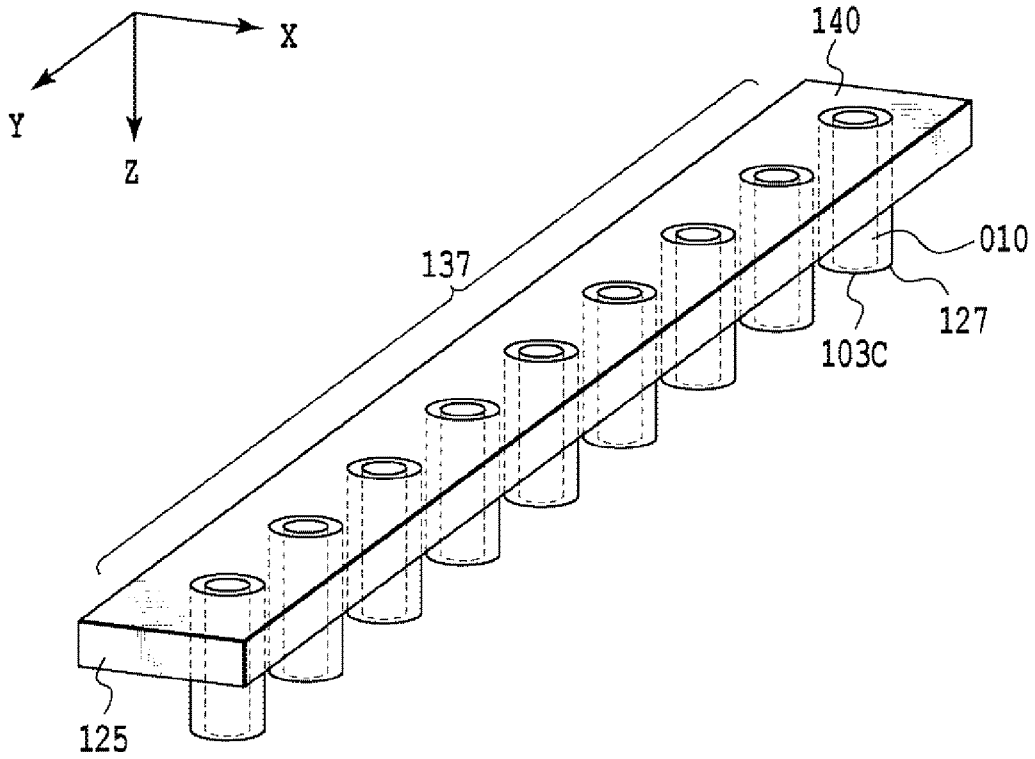
FIG. 26 is a perspective view illustrating liquid surface driving mechanisms of the liquid ejection head in FIG. 24.

FIG. 26 is a perspective view illustrating a liquid surface driving mechanism in the present embodiment. As illustrated in FIG. 26, a plurality of liquid surface driving mechanisms 103C are arrayed in a single line on a base 125 and constitute a single liquid surface driving mechanism line 137. This liquid surface driving mechanism line 137 constitutes a piezoelectric unit 140. In the present embodiment, cylindrical piezo-electric elements are used for the liquid surface driving mechanisms 103C. When a voltage is applied to such a cylindrical piezoelectric element, a cylindrical part 127 radially expands and contracts, and pressure variation in liquid inside a collection pressure chamber 010 is conceivable. Utilizing this pressure variation, a liquid surface 009 is projected out from a collection nozzle 102.

Figure 27A:
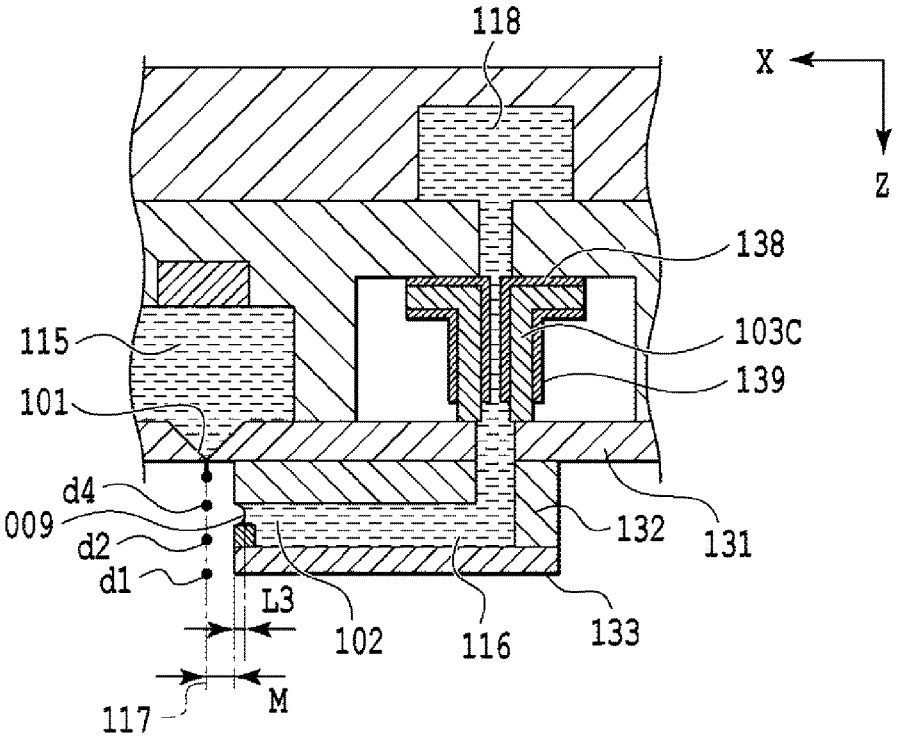
FIG. 27A is a cross-section for explaining operation of a collection nozzle.
Figure 27B:
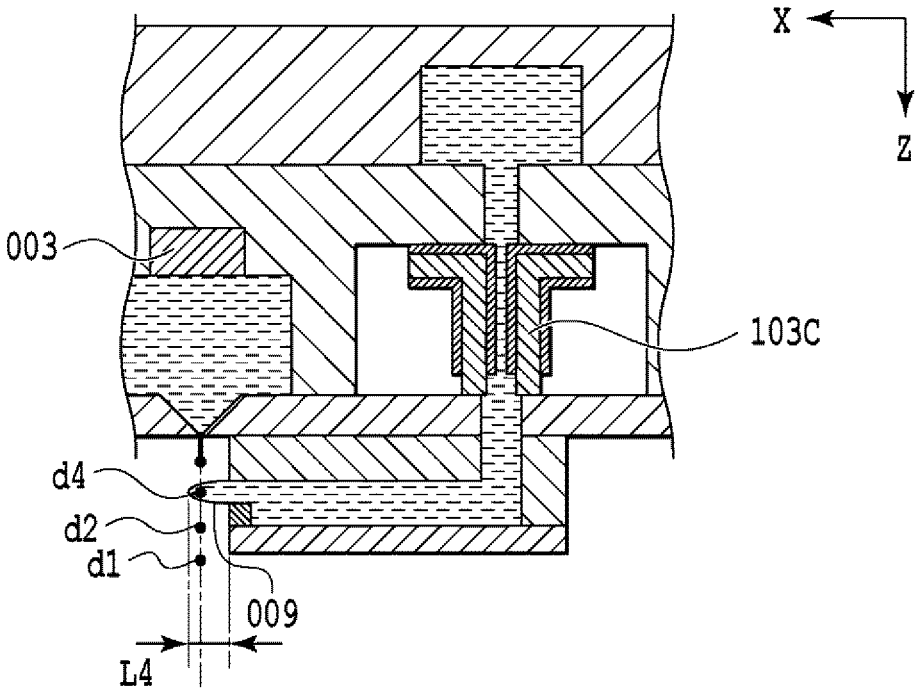
FIG. 27B is a cross-section for explaining operation of a collection nozzle.

FIGS. 27A and 27B illustrate operation of a collection nozzle 102, with FIG. 27A illustrating operation with respect to a used droplet, and FIG. 27B illustrating operation with respect to an unused droplet. In FIG. 27A, liquid stored in a liquid tank 001 is pressurized by a pressure pump 002 and supplied to a head 004. Vibration is applied to liquid pushed out from the head 004 (a liquid column) by a vibrating mechanism 003 to form regular droplets. Formed droplets fly along a droplet flight trajectory 117. Meanwhile, at a liquid surface 009 of a collection nozzle 102, negative pressure (i.e., a pressure value smaller than atmospheric pressure) by a collection pump 006 and meniscus force are mutually balanced, thereby causing a liquid surface 009 to be held near the collection nozzle 102. When a used droplet passes through beside the collection nozzle 102, a liquid surface driving mechanism 103C is not made to drive, and thus the liquid surface 009 is held near the collection nozzle 102 as discussed above. Consequently, used droplets fly along the droplet flight trajectory 117, pass through the collection nozzle 102 position, and land on a print medium, and an image is formed.

In FIG. 27B, when a first unused droplet d4 passes through the collection nozzle 102 position, the liquid surface driving mechanism 103C is driven. In so doing, the liquid surface 009 greatly projects out from the collection nozzle 102 (L4) and reliably collides and unites with the flying unused droplet, which is collected inside the collection nozzle 102. After that, the projected liquid surface 009 returns to its original position by the surface tension of the liquid surface. By keeping the pressure at a constant negative pressure with the collection pump 006, the liquid surface of the collection nozzle 102 is still kept at a constant position after capture. Captured droplets are gradually sent to an ink adjuster 007, subjected to foreign matter removal and viscosity adjustment, then once again pressurized by a pressure pump 002 and recirculated into the head 004 for reuse.

As discussed above, the depth (L6) of a droplet flight slit 107 can be made shallower by positioning a liquid surface driving mechanism 103C on side of an ejection nozzle plate 131 opposite to a collection nozzle 102. Thus, since the distance between an ejection aperture and a print medium can be shortened further than a configuration that disposes a liquid surface driving mechanism 103 between an ejection nozzle plate and a print medium, a high droplet landing precision on a print medium can be obtained.

Also, by disposing a liquid surface driving mechanism 103C at a position on the side of an ejection nozzle plate 131 opposite to an ejection nozzle and also contacting the ejection nozzle plate, a collection nozzle can be disposed closer towards an ejection nozzle (i.e., higher) in the droplet flight direction (the Z arrow direction). Thus, since the channel length of a first collection channel 116 can be shortened, the projection magnitude of a liquid surface 009 produced by a collection nozzle 102 can be increased with the driving of a liquid surface driving mechanism 103.

Also, by disposing a liquid surface driving mechanism 103C on the side of an ejection nozzle plate 131 opposite to a collection nozzle, the depth of the above-discussed droplet flight slit 107 can be made shallower, and the slit width of a droplet flight slit 107 (L7 in FIG. 25A) can be made broader. In so doing, a wiping operation for wiping off mist accumulated at an ejection nozzle or collection nozzle disposed inside a droplet flight slit 107 can be easily conducted.

Also, by disposing a liquid surface driving mechanism 103C on the side of an ejection nozzle plate 131 opposite to a collection nozzle, the piezoelectric elements (which are electronic parts) are not directly scuffed by a blade during a wiping operation, and thus the durability of a liquid surface driving mechanism 103C can be raised.

More specifically, a cylindrical piezoelectric element provided with apertures at both ends was manufactured as a liquid surface driving mechanism 103C. This cylindrical piezoelectric element is affixed to a base 125 at one end, expanding and contracting along the radius of the cylinder as a result of applying voltage. A piezoelectric unit 140 was manufactured as the liquid surface driving mechanism 103C of the present embodiment. In the piezoelectric unit 140, a number of cylindrical piezoelectric elements equal to the number of collection nozzles on a nozzle line are arrayed upon a single base 125 (on a base member) (see FIG. 26). More specifically, the piezoelectric unit 140 is configured such that a first electrode 138 (common electrode) is deposited or patterned on the inner surfaces of respective cylindrical units 127 pre-polarized in the radial direction and on the front surface of the base 125, while second electrodes 139 (individual electrodes) are deposited or patterned on the outer surface of the respective cylindrical units 127 and on the back surface of the base 125. Sputtering, etc. may be used for deposition, or dry etching may be used for patterning. The base width of a piezoelectric unit 140 in the present embodiment (i.e., the width in the X arrow direction in FIG. 26) is 1.5 mm. As illustrated in FIGS. 25A and 25B, a piezoelectric unit 140 is disposed for each respective collection nozzle line 106, contacting the ejection nozzle plate 131 and on the same side as the liquid surface driving mechanism 103 (−Z arrow direction).

In FIG. 24, the nozzle spacing in the depth direction (Y arrow direction) is 500 μm, and the nozzle spacing in the horizontal direction is 3 mm. Liquid having a viscosity of 1 cP to 40 cP and a surface tension of 30 mN/m was used. If the diameter of an ejection nozzle 101 is to ken to be 7.4 μm, the pressure of the pressure pump 002 to be 0.8 MPa, and the vibrational frequency of the vibrating mechanism 003 to be 50 kHz, then the droplet size is 4 pL (diameter approximately 20 μm) and the ejection velocity is approximately 10 m/s. In an ejection nozzle 101, first a liquid column is formed, and a droplet forms at a location distanced from the ejection nozzle 101 by approximately 500 μm to 800 μm. A collection nozzle 102 has a diameter of 80 μm, and is provided at a point 1 mm away from an ejection nozzle 101 in the droplet flight direction. The thickness of a second collection channel plate 133 covering the collection nozzles 102 and collection channels 116 was taken to be 0.2 mm in the present embodiment. Thus, it was possible to reduce the depth (L6) of the droplet flight slits 107 to 1.2 mm.

Ink inside a collection nozzle 102 is controlled by constant negative pressured by a collection pump 006 (approximately −1.4 kPa based on atmospheric pressure), and an ink meniscus is formed at the collection nozzle 102. When an unused droplet passes through, the liquid surface 009 at the collection nozzle 102 is made to advance by a liquid surface driving mechanism 103, and is able to collect the droplet by colliding with it.

According to a configuration of the present embodiment, it is possible to shorten the flight distance of used droplets, thereby making it possible to raise the landing precision of used droplets.

In this way, there is provided a liquid ejection head that causes a liquid surface from a collection nozzle to project out by the action of a liquid surface driving mechanism into the trajectory of a droplet ejected from an ejection nozzle provided on a nozzle plate, wherein the nozzle plate is provided between the liquid surface driving mechanism of the collection nozzle and the collection nozzle. Thus, it is possible to realize a liquid ejection head able to raise the landing precision of used droplets (print droplets).

(Modification 1)

Figure 28:
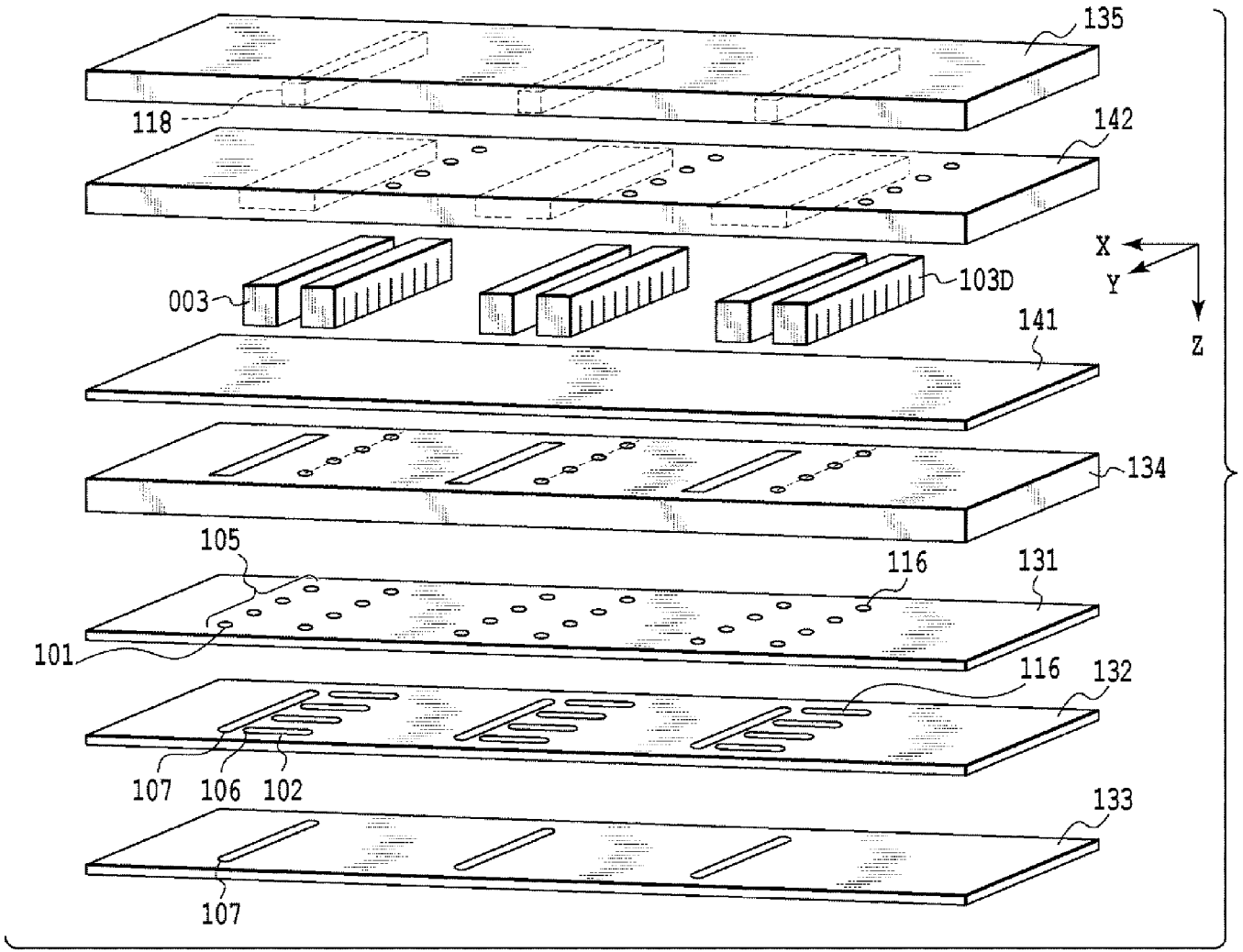
FIG. 28 is an exploded perspective view of a liquid ejection head in accordance with a modification of the third embodiment.
Figure 29A:
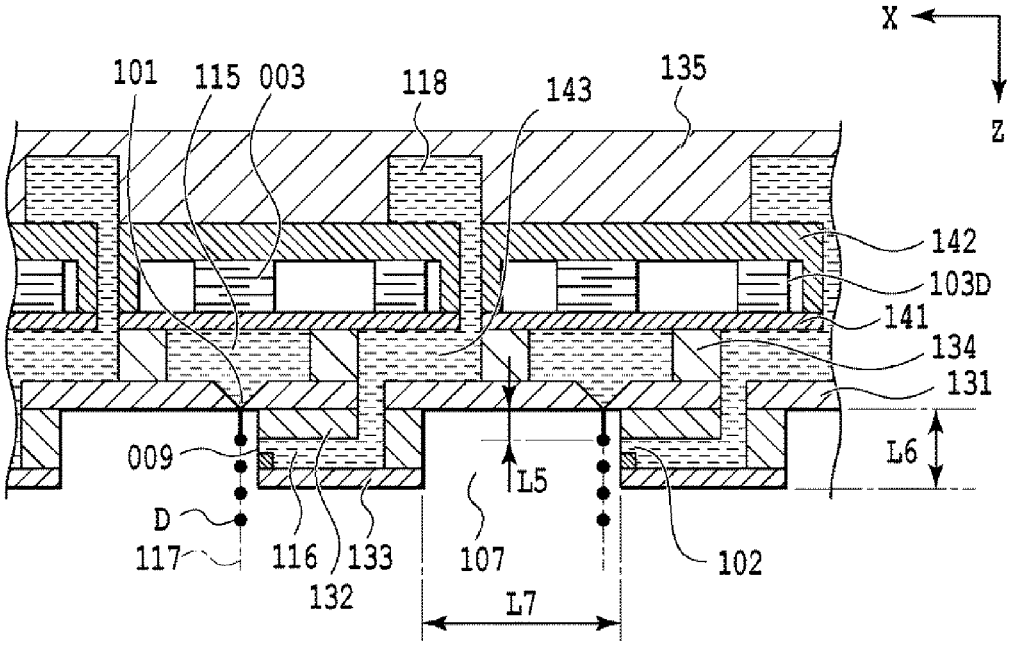
FIG. 29A is a cross-section of the liquid ejection head in FIG. 28.
Figure 29B:
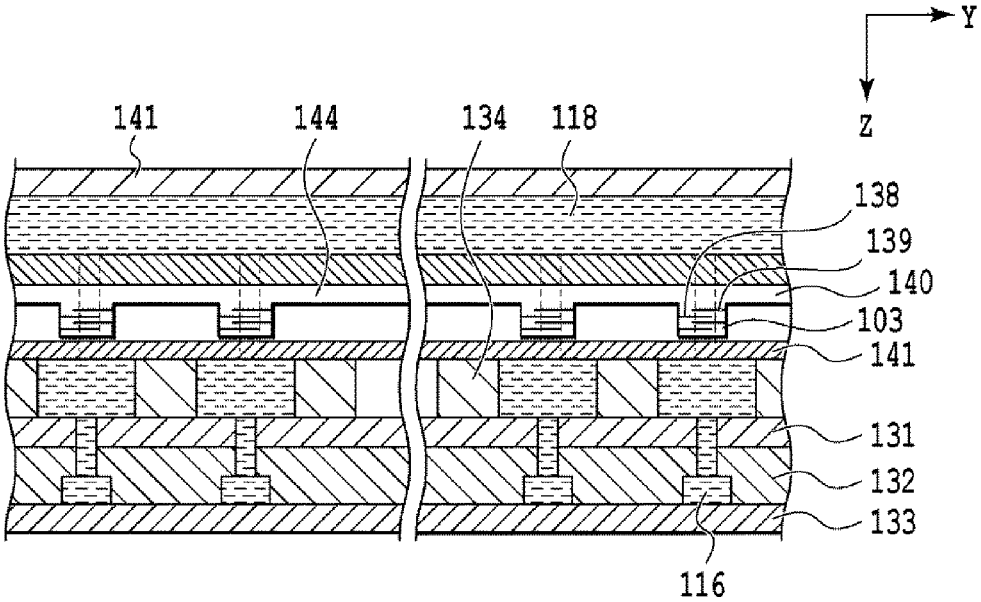
FIG. 29B is a cross-section of the liquid ejection head in FIG. 28.

Next, a modification of the third embodiment will be explained. FIG. 28 is an exploded perspective view of a liquid ejection head configured with another type of piezoelectric element, and FIGS. 29A and 29B illustrate cross-sections thereof. A supply channel 115 and a collection pressure chamber 143 are formed by an ejection nozzle plate 131, a first manifold member 134, and a vibrating plate 141. A vibrating mechanism 003 and a liquid surface driving mechanism 103D are disposed on the side of the vibrating plate 141 opposite to an ejection nozzle 101. The liquid surface driving mechanism 103D is stacked piezoelectric elements. A liquid surface driving mechanism 103 corresponding to a collection nozzle 102 on a collection nozzle line 106 becomes an integrated piezoelectric unit 140 due to a support substrate 144. A first electrode 138 and a second electrode 139 are provided internally in each liquid surface driving mechanism 103D, and wiring is formed on the front surface of the support substrate 144. In the piezoelectric unit 140, the front surface of the support substrate 144 is adhesively affixed to a third manifold member 142, and in addition, each liquid surface driving mechanism 103 is adhesively affixed to the vibrating plate 141. Even with the liquid surface driving mechanism 103D made up of stacked piezoelectric elements discussed above, it is possible to cause the liquid surface 009 of a collection nozzle 102 to project outwards.

In the present modification, a two-dimensional multi-nozzle head is used wherein nozzle lines are formed by arranging nozzles in the Y arrow direction and the nozzles are plurally disposed in the X arrow direction, as also explained in FIGS. 24, 25A, and 25B. Hereinafter, this two-dimensional multi-nozzle head will be explained in detail. As illustrated in FIG. 24, a liquid ejection head is manufactured by stacking planar members.

Figure 30:
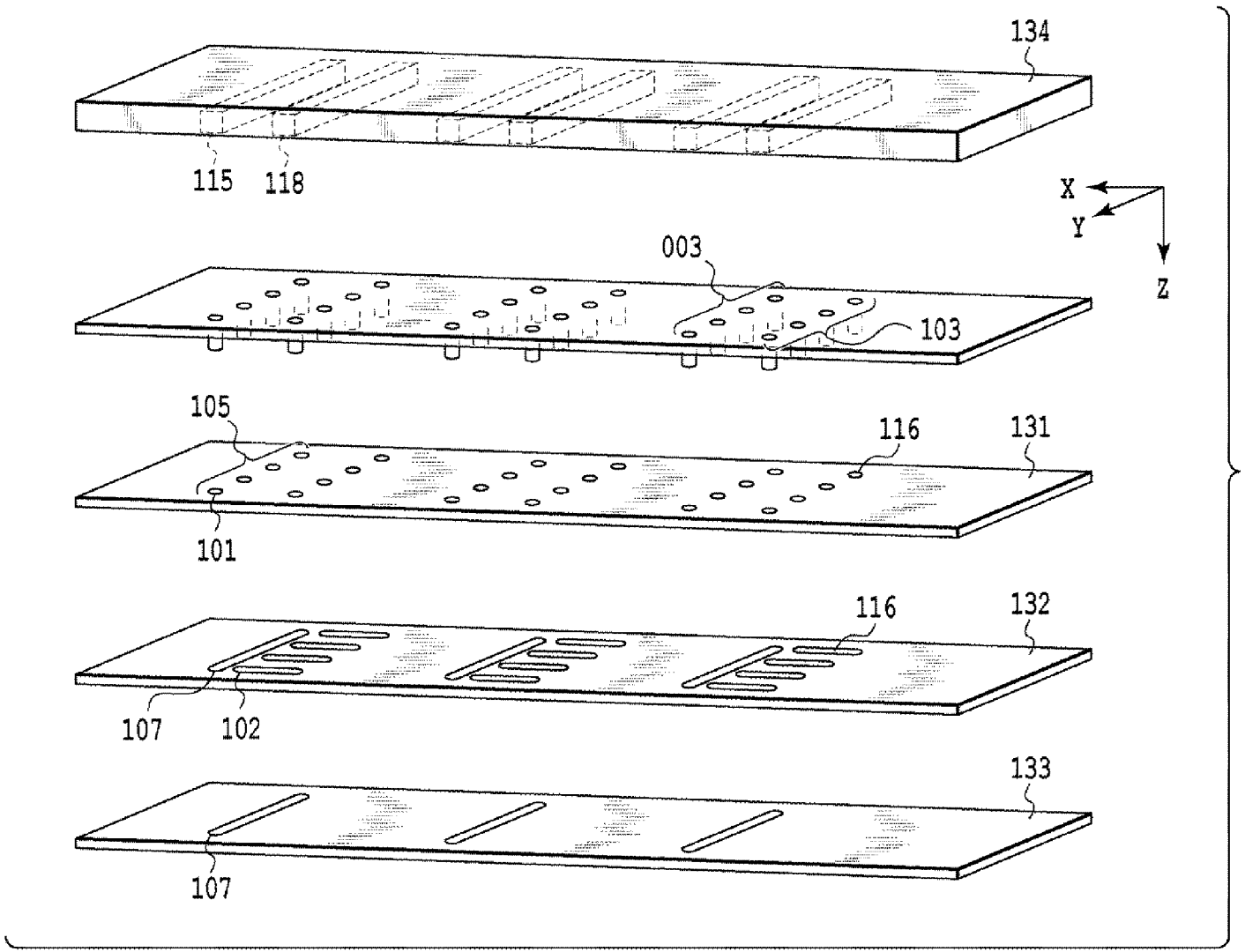
FIG. 30 is an exploded perspective view of a liquid ejection head in accordance with another modification of the third embodiment.
Figure 31:
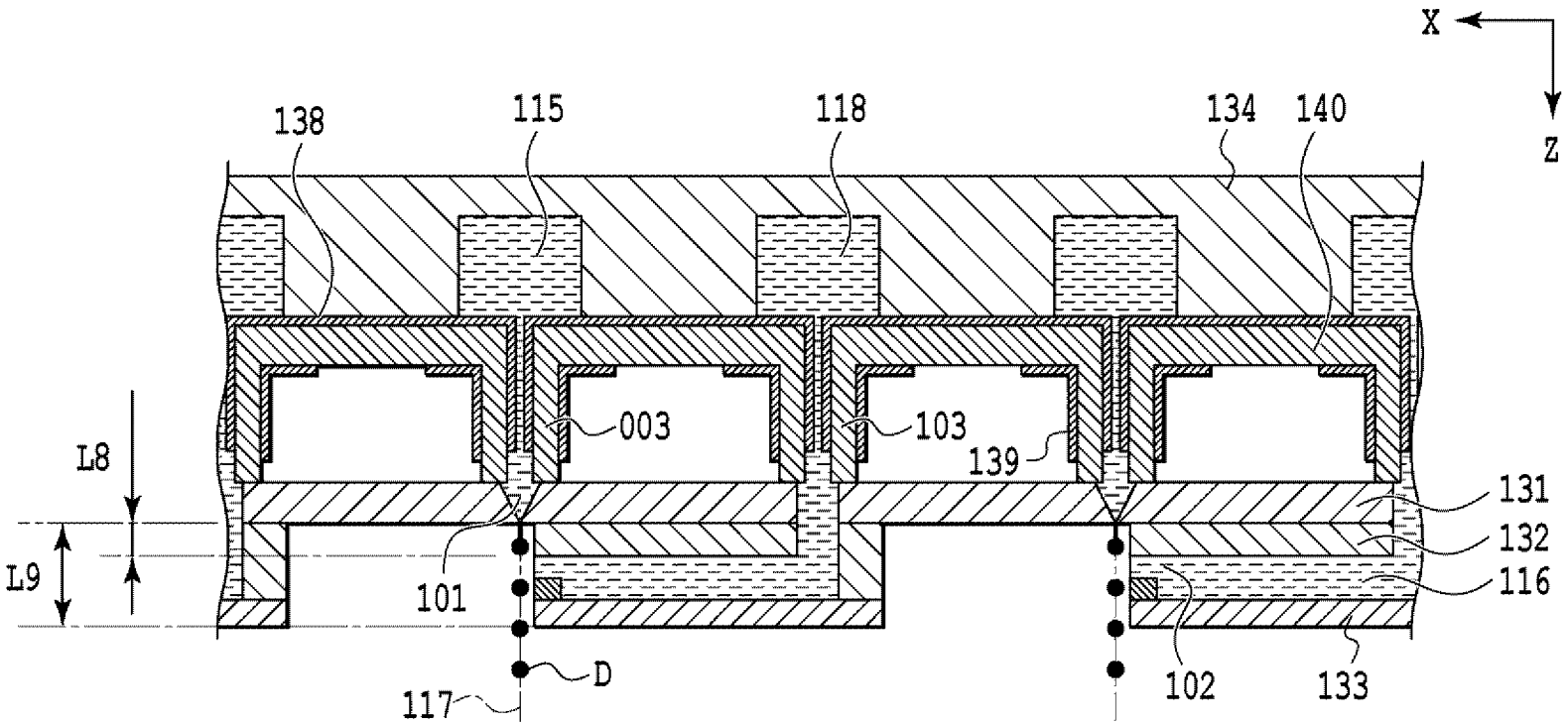
FIG. 31 is a cross-section of the liquid ejection head in FIG. 30.
Figure 32:
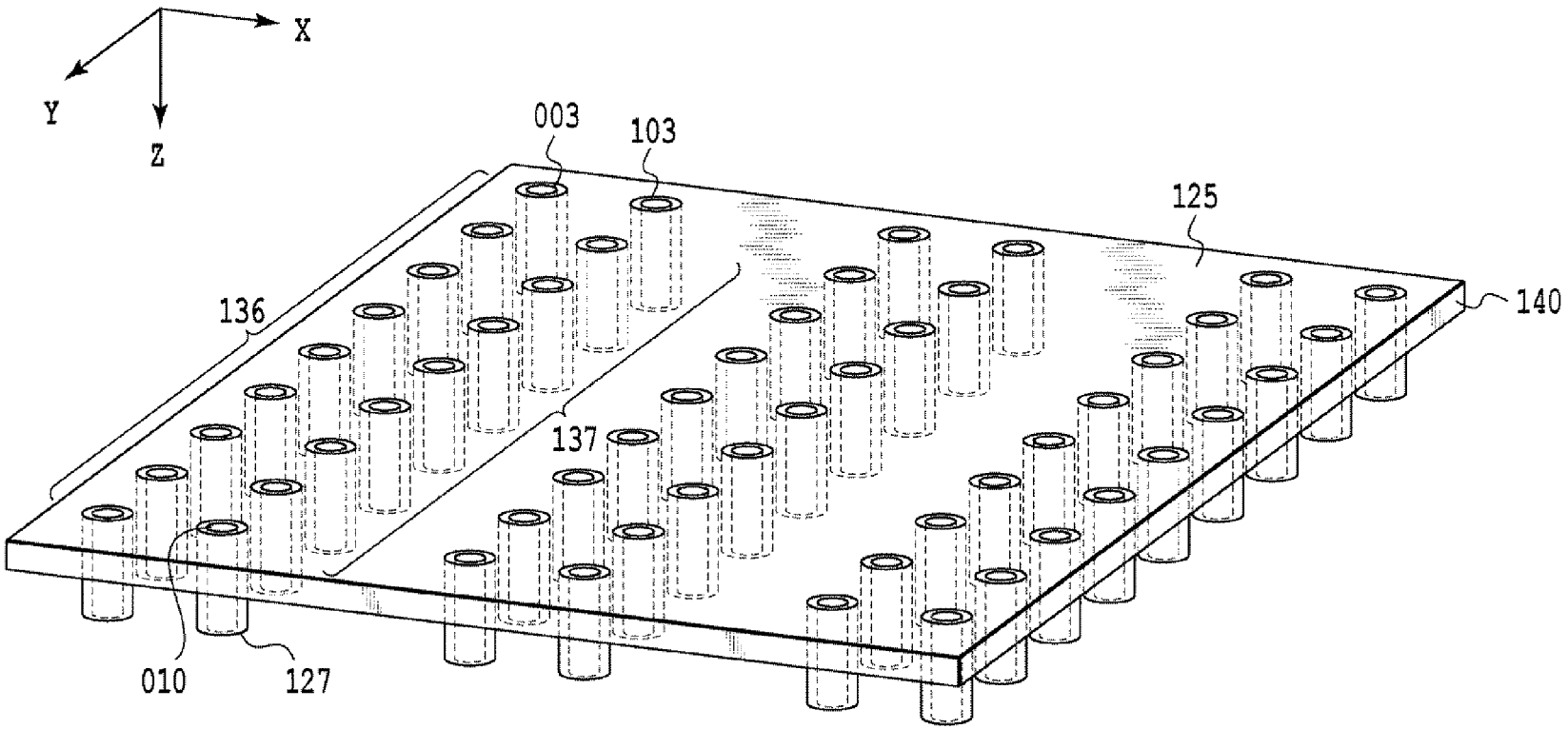
FIG. 32 is a perspective view of liquid surface driving mechanisms in the liquid ejection head in FIG. 30.

Next, another modification of the third embodiment of the present invention will be explained. FIG. 30 is an exploded perspective view of a liquid ejection head in accordance with the present modification, and FIG. 31 is a cross-section of a similar liquid ejection head. In the present modification, the vibrating mechanism 003 in the third embodiment is made up of cylindrical piezoelectric elements whose members are identical to those of the liquid surface driving mechanism 103C used in the collection nozzles. Additionally, FIG. 32 is a perspective view illustrating liquid surface driving mechanism lines in the present modification. In the present modification, a piezo-electric unit 138 was manufactured in which vibrating mechanism lines 136 corresponding to respective ejection nozzle lines and liquid surface driving mechanism lines 137 corresponding to respective collection nozzle lines are integrated onto a single base 125. As in the drawings, the vibrating mechanism lines 136 and the liquid surface driving mechanism lines 137 are plurally and two-dimensionally disposed on the base 125 in a row direction and a column direction. Also, a piezoelectric unit 140 is disposed at a position contacting an ejection nozzle plate in the −Z arrow direction with respect to the ejection nozzle plate 131.

By disposing a vibrating mechanism 003 made up of a cylindrical piezoelectric element at a position near an ejection nozzle 101, the pressure variation imparted to liquid inside the ejection nozzle 101 increases, and thus the droplet formation distance (L8) for liquid pushed out from the ejection nozzle 101 can be shortened. In so doing, the disposition of a collection nozzle 102 in the droplet flight direction can be brought even closer towards the ejection nozzle compared to the third embodiment, and thus the depth (L9) of a droplet flight slit is made even shallower.

According to the configuration of the present modification, the flight distance of used droplets to a print medium is additionally shortened. Also, by integrating two types of piezoelectric elements used for vibrating mechanisms and liquid surface driving mechanisms, the number of assembly steps is reduced, and relative positional precision is improved.

In this way, there is provided a liquid ejection head that causes a liquid surface from a collection nozzle to project out by the action of a liquid surface driving mechanism into the trajectory of a droplet ejected from an ejection nozzle provided on a nozzle plate, wherein the nozzle plate is provided between the liquid surface driving mechanism of the collection nozzle and the collection nozzle. Thus, it is possible to realize a liquid ejection head able to raise the landing precision of used droplets (print droplets).

Since a liquid ejection head of the present invention imparts little or no effect on the flight of used droplets during droplet sorting and collection, high landing precision is obtained. Such a liquid ejection head can be utilized in the manufacturing of high-definition liquid ejection heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-169383, filed Jul. 28, 2010, 2010-245541, filed Nov. 1, 2010, and 2010-279364, filed Dec. 15, 2010 which are hereby incorporated by reference herein in their entirety.

The invention claimed is:

1. A liquid ejection head, comprising:

a first nozzle that continuously ejects droplets; and a collecting mechanism configured to collect unused droplets which are not used from among the droplets continuously ejected from the first nozzle, wherein the collecting mechanism includes a second nozzle able to project a liquid surface out to a position in the trajectory along which droplets ejected from the first nozzle fly, and a liquid surface driving mechanism that collects the unused droplets by causing the liquid surface from the second nozzle to project outwards, causing the projected liquid surface to collide and unite with an unused droplet ejected from the first nozzle, and causing the projected liquid surface to retreat.

2. The liquid ejection head according to claim 1, wherein the liquid surface driving mechanism is provided adjacent to the second nozzle or to a channel that communicates with the second nozzle.

3. The liquid ejection head according to claim 1, wherein the collecting mechanism includes, provided with respect to the second nozzle, a supply channel that supplies liquid to the second nozzle and a discharge channel that discharges liquid from the second nozzle.

4. The liquid ejection head according to claim 3, wherein liquid is made to circulate from the supply channel to the discharge channel at least while droplets are being ejected from the first nozzle.

5. The liquid ejection head according to claim 1, wherein the collecting mechanism includes a plurality of the second nozzles with respect to one first nozzle.

6. The liquid ejection head according to claim 5, wherein the collecting mechanism includes a plurality of liquid surface driving mechanisms that independently drive respective liquid surfaces of a plurality of second nozzles.

7. The liquid ejection head according to claim 1, wherein an aperture of the second nozzle is at least twice the diameter of an unused droplet ejected from the first nozzle.

8. The liquid ejection head according to claim 1, wherein the first nozzle, the second nozzle, a flight path through which droplets ejected from the first nozzle pass, a discharge channel that discharges liquid from the second nozzle, and supply channels that supply liquid to the first or second nozzle are demarcated by a plurality of stacked planar members.

9. The liquid ejection head according to claim 8, wherein the second nozzle is formed in a direction intersecting the flight path.

10. The liquid ejection head according to claim 8, wherein the liquid surface driving mechanism includes a vibrating plate and a piezoelectric element provided on the vibrating plate, the vibrating plate being one of the plurality of planar members.

11. The liquid ejection head according to claim 8, wherein among the stacked plurality of planar members, the liquid surface driving mechanism is provided on the side of a planar member that demarcates the first nozzle opposite to a planar member that demarcates the second nozzle.

12. The liquid ejection head according to claim 11, further comprising:

a vibrating mechanism that vibrates liquid supplied to the first nozzle to cause droplet formation, wherein the liquid surface driving mechanism and the vibrating mechanism respectively include piezoelectric elements, and in addition, are provided with respect to a common planar member.

13. The liquid ejection head according to claim 12, wherein each of the piezoelectric elements has a cylindrical shape provided with apertures at both ends, with a first electrode formed on the inner surface of the cylinder and a second electrode formed on the outer surface, the piezoelectric elements being each radially polarized with the aperture of one end affixed by a base member, and being plurally and two-dimensionally disposed on the base member in a row direction and a column direction.

14. The liquid ejection head according to claim 1, wherein the collecting mechanism includes, inside a channel of the second nozzle, a structure for restricting the flow of liquid in an area between a centerline area of the second nozzle and an inner peripheral wall surface area of the second nozzle that is related to the direction in which the liquid surface projects out from the second nozzle.

15. The liquid ejection head according to claim 14, wherein the structure acts to decrease the flow rate near the inner peripheral wall surface area and increase the flow rate in the centerline area compared to a case where the structure is not present.

16. The liquid ejection head according to claim 14, wherein the structure includes a cylindrical unit disposed concentrically with the second nozzle, and a support unit that supports the cylindrical unit.

17. The liquid ejection head according to claim 14, wherein the structure is a ring-shaped member that fits against the inner peripheral wall surface of the second nozzle.

18. The liquid ejection head according to claim 14, wherein the structure comprises a plurality of projecting members arranged along the circumference of the inner peripheral wall surface of the second nozzle.

19. The liquid ejection head according to claim 14, wherein the structure is disposed away from an aperture of the second nozzle.

20. The liquid ejection head according to claim 19, wherein the structure is disposed away from the aperture of the second nozzle by at least a distance greater than the inner radius of the aperture.

21. A liquid ejection apparatus, comprising:

a liquid ejection head including a first nozzle that continuously ejects droplets and a collecting mechanism configured to collect unused droplets which are not used from among the droplets continuously ejected from the first nozzle, wherein the collecting mechanism includes a second nozzle able to project a liquid surface out to a position in the trajectory along which droplets ejected from the first nozzle fly, and a liquid surface driving mechanism that collects the unused droplets by causing a liquid surface from the second nozzle to project outwards, causing the projected liquid surface to collide and unite with an unused droplet ejected from the first nozzle, and causing the projected liquid surface to retreat;

a vibrating mechanism that vibrates liquid supplied to the first nozzle to cause droplet formation; and a pump that causes liquid collected by the second nozzle to be recirculated into the first nozzle.

* * * * *